US008242871B2

(12) United States Patent
Kobayashi et al.

(10) Patent No.: US 8,242,871 B2
(45) Date of Patent: Aug. 14, 2012

(54) TRANSFORMER

(75) Inventors: Katsumi Kobayashi, Tokyo (JP); Yutaka Hatakeyama, Tokyo (JP); Makoto Ono, Tokyo (JP)

(73) Assignee: TDK Corporation, Tokyo (JP)

( * ) Notice: Subject to any disclaimer, the term of this patent is extended or adjusted under 35 U.S.C. 154(b) by 20 days.

(21) Appl. No.: 12/859,510

(22) Filed: Aug. 19, 2010

(65) Prior Publication Data

US 2011/0043315 A1 Feb. 24, 2011

(30) Foreign Application Priority Data

Aug. 24, 2009 (JP) ..... 2009-193588

(51) Int. Cl.

| | |
|---|---|
| ***H01F 27/30*** | (2006.01) |
| ***H01F 27/29*** | (2006.01) |
| ***H01F 27/28*** | (2006.01) |
| ***H01F 7/06*** | (2006.01) |

(52) U.S. Cl. ..... 336/198; 336/192; 336/208; 336/182; 29/602.1; 29/606

(58) Field of Classification Search ..... 336/192, 336/170, 182, 198, 208, 220–222; 29/606
See application file for complete search history.

(56) References Cited

U.S. PATENT DOCUMENTS

| | | | | |
|---|---|---|---|---|
| 4,544,906 | A * | 10/1985 | Mota | 336/206 |
| 4,774,756 | A * | 10/1988 | Dethienne | 29/605 |
| 4,857,877 | A | 8/1989 | Dethienne | |
| 6,937,129 | B2 * | 8/2005 | Hsueh et al. | 336/208 |
| 7,167,069 | B2 | 1/2007 | Haga | |
| 7,456,718 | B1 * | 11/2008 | Teng et al. | 336/192 |
| 7,515,026 | B1 * | 4/2009 | Liu et al. | 336/192 |
| 8,031,040 | B1 * | 10/2011 | Folker et al. | 336/198 |
| 2002/0017975 | A1 * | 2/2002 | Chiang et al. | 336/198 |
| 2005/0275498 | A1 | 12/2005 | Haga | |
| 2010/0214053 | A1 * | 8/2010 | Chen et al. | 336/221 |

FOREIGN PATENT DOCUMENTS

| | | |
|---|---|---|
| JP | A-62-088313 | 4/1987 |
| JP | U-01-065113 | 4/1989 |
| JP | A-02-068911 | 3/1990 |
| JP | A-10-125525 | 5/1998 |
| JP | A-2000-182849 | 6/2000 |
| JP | A-2000-208339 | 7/2000 |
| JP | A-2005-353954 | 12/2005 |
| JP | A-2009-105342 | 5/2009 |
| JP | A-2010-238842 | 10/2010 |

OTHER PUBLICATIONS

Office Action issued in Japanese Patent Application No. 2009-193588 dated Aug. 25, 2011 (with translation).

* cited by examiner

*Primary Examiner* — Mohamad Musleh
*Assistant Examiner* — Mangtin Lian
(74) *Attorney, Agent, or Firm* — Oliff & Berridge, PLC

(57) ABSTRACT

The transformer includes a bobbin, a plurality of terminal electrode, a primary coil, a secondary coil, and a hook part. The bobbin includes a core portion extending in an axial direction, and terminal bases fixed at both ends of the core portion in the axial direction. The plurality of terminal electrode regions is provided on the terminal bases. Each terminal electrode region is provided with a wire connection part. The primary coil comprises a plurality of primary wires. The secondary coil comprises a plurality of secondary wires. The hook part is disposed between the core portion and one of the terminal electrode regions and configured to hook at least one of the primary wires and the secondary wires.

5 Claims, 26 Drawing Sheets

TRANSFORMER

CROSS REFERENCE TO RELATED APPLICATION

This application claims priority from Japanese Paten Application No. 2009-193588 filed Aug. 24, 2009. The entire content of this priority application is incorporated herein by reference.

TECHNICAL FIELD

The present invention relates to a transformer, and particularly to a transformer having a plurality of primary coils and a plurality of secondary coils wound coaxially to each other.

BACKGROUND

Coil components used in transformers and the like are conventionally configured of a coil wound about a bobbin, with the lead wires of the coil anchored to pins provided on the bobbin. One problem with these conventional coil components is that the lead wires tend to rise off the bobbin when attached to the pins. Some transformer technologies, such as that disclosed in Japanese unexamined patent application publication No. 2005-353954, provide protrusions on the bobbin and hook the lead wires of the coil on these protrusions to prevent the lead wires from separating too far from the bobbin.

However, the protrusions in the configuration of the invention described above are positioned farther from the coil winding than the pins so that the section of the lead wires between the coil and the protrusions projects away from the bobbin. Further, in a process for manufacturing transformers that incorporates machine-automated winding, a nozzle is employed to pay out the wire when winding the coil. Since the distance between the coil winding and the protrusions at which the lead wires must be hooked is considerably great in the above invention, the nozzle must travel over a wider range, leading to the potential for wire interference that can reduce productivity.

SUMMARY

In view of the foregoing, it is an object of the present invention to provide a transformer that restricts the lead wires from projecting too far outward from the bobbin and that is designed to avoid interference between wires when the lead wires are run from the coil winding to the protrusions.

In order to attain the above and other objects, the invention provides a transformer. The transformer includes a bobbin, a plurality of terminal electrode, a primary coil, a secondary coil, and a hook part. The bobbin includes a core portion extending in an axial direction, and terminal bases fixed at both ends of the core portion in the axial direction. The plurality of terminal electrode regions is provided on the terminal bases. Each terminal electrode region is provided with a wire connection part. The primary coil comprises a plurality of primary wires each having a first winding portion wound over the core portion, a first connecting portion connected to the one of wire connection parts, and a first leading portion extending from the first winding portion to the first connecting portion. The secondary coil comprises a plurality of secondary wires each having a second winding portion wound over the first winding portion, a second connecting portion connected to remaining one of the wire connection parts, and a second leading portion extending from the second winding portion to the second connecting portion. The hook part is disposed between the core portion and one of the terminal electrode regions and configured to hook at least one of the first leading portion and the second leading portion.

According to another aspect, the present invention provides a method for manufacturing a transformer. The method includes preparing a transformer body including: a bobbin including a core portion on which a plurality of primary wires are to be wound, and terminal bases fixed at both ends of the core portion in an axial direction of the core portion, the core portion being provided with a plurality of partition walls arrayed in the axial direction for dividing the core portion into a plurality of wire winding sections and the plurality of partition walls being respectively formed with a plurality of grooves; a plurality of terminal electrode regions provided on the terminal bases and provided with wire connection parts to which ends of the plurality of primary wires and a plurality of secondary wires to be wound over the plurality of primary wires are to be connected, the plurality of terminal electrode regions being provided with a plurality of terminal electrodes, respectively, and an inter-electrode groove being defined between neighboring terminal electrodes; and a hook part disposed between the core portion and one of the terminal electrode regions for hooking at least one of the primary wire and the secondary wire, connecting the primary wire to one of the wire connection parts, passing the primary wire connected to the one of the wire connection parts through the inter-electrode groove, hooking the primary wire on the hook part, winding the primary wire over an intended wire winding section after passing the primary wire through all grooves of the partition walls from the groove nearest to the hook part to the groove nearest to the intended wire winding section, hooking the primary wire on the hook part after the primary wire wound over the wire winding section has been passed through the all grooves of the partition walls from the groove nearest to the intended wire winding section to the groove nearest to the hook part, passing the primary wire hooked over the hook part through the inter-electrode groove, and connecting the primary wire to remaining one of the connection parts of the terminal electrodes.

BRIEF DESCRIPTION OF THE DRAWINGS

The particular features and advantages of the invention as well as other objects will become apparent from the following description taken in connection with the accompanying drawings, in which:

FIG. 3(*b*) is a top perspective view representing the inner cylinder part and the terminal base of the transformer according to the first embodiment;

DETAILED DESCRIPTION

Figure 1:
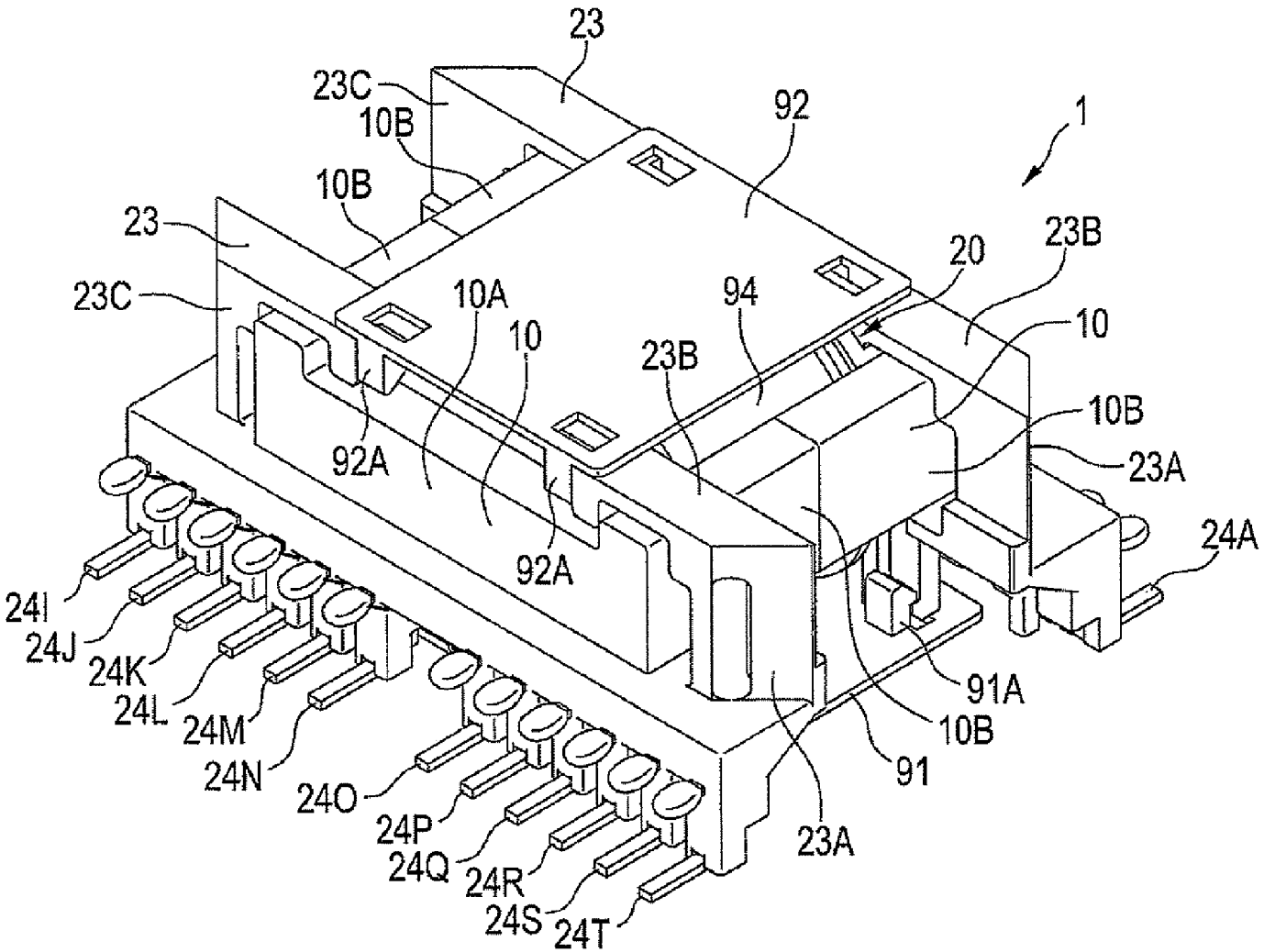
FIG. 1 is a top perspective view of a transformer according to a first embodiment of a present invention.
Figure 2:
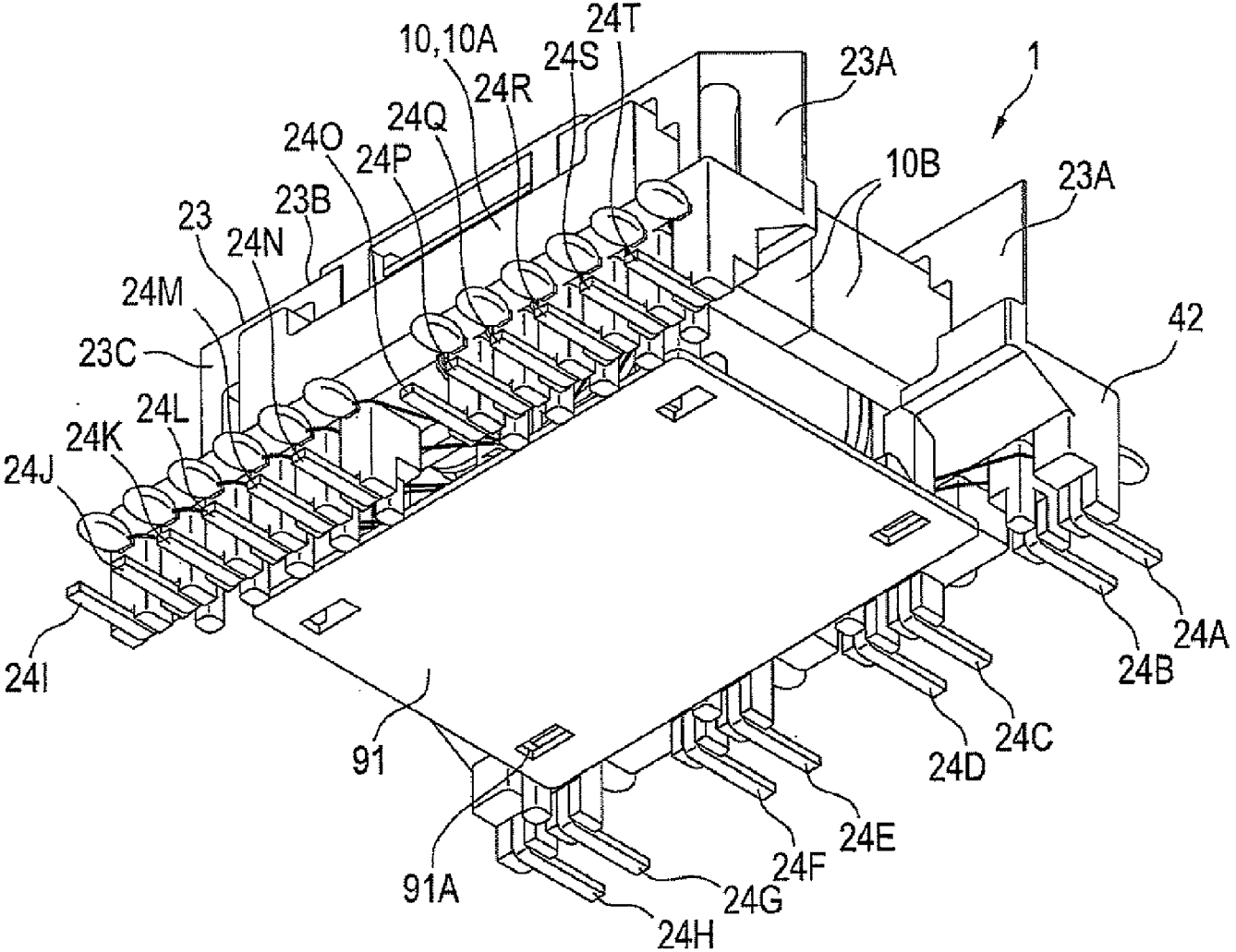
FIG. 2 is a bottom perspective view of the transformer according to the first embodiment.

Next, a transformer according to a first embodiment of the present invention will be described while referring to FIGS. 1 through 20. A transformer 1 shown in FIG. 1 is employed in IGBT modules suited for inverters in hybrid vehicles. The transformer 1 includes a pair of cores 10, a bobbin 20, wires 50 (see FIG. 7 and subsequent drawings), and casing 90.

Each of the cores 10 has a bottom wall part 10A, a pair of side wall parts 10B extending at right angles to the bottom wall part 10A from opposing ends thereof, and a center wall part (not shown) extending along a normal to the bottom wall part 10A from a central portion of the same. Thus, the entire core 10 is formed substantially in the shape of the letter E. The distal ends of the side wall parts 10B and the center wall part of one core 10 contact the distal ends of the side wall parts 10B and the center wall part of the other core 10 within a single plane so that the two cores 10 are disposed in confrontation with each other and are symmetrical with respect to the plane of contact.

Figure 3A:
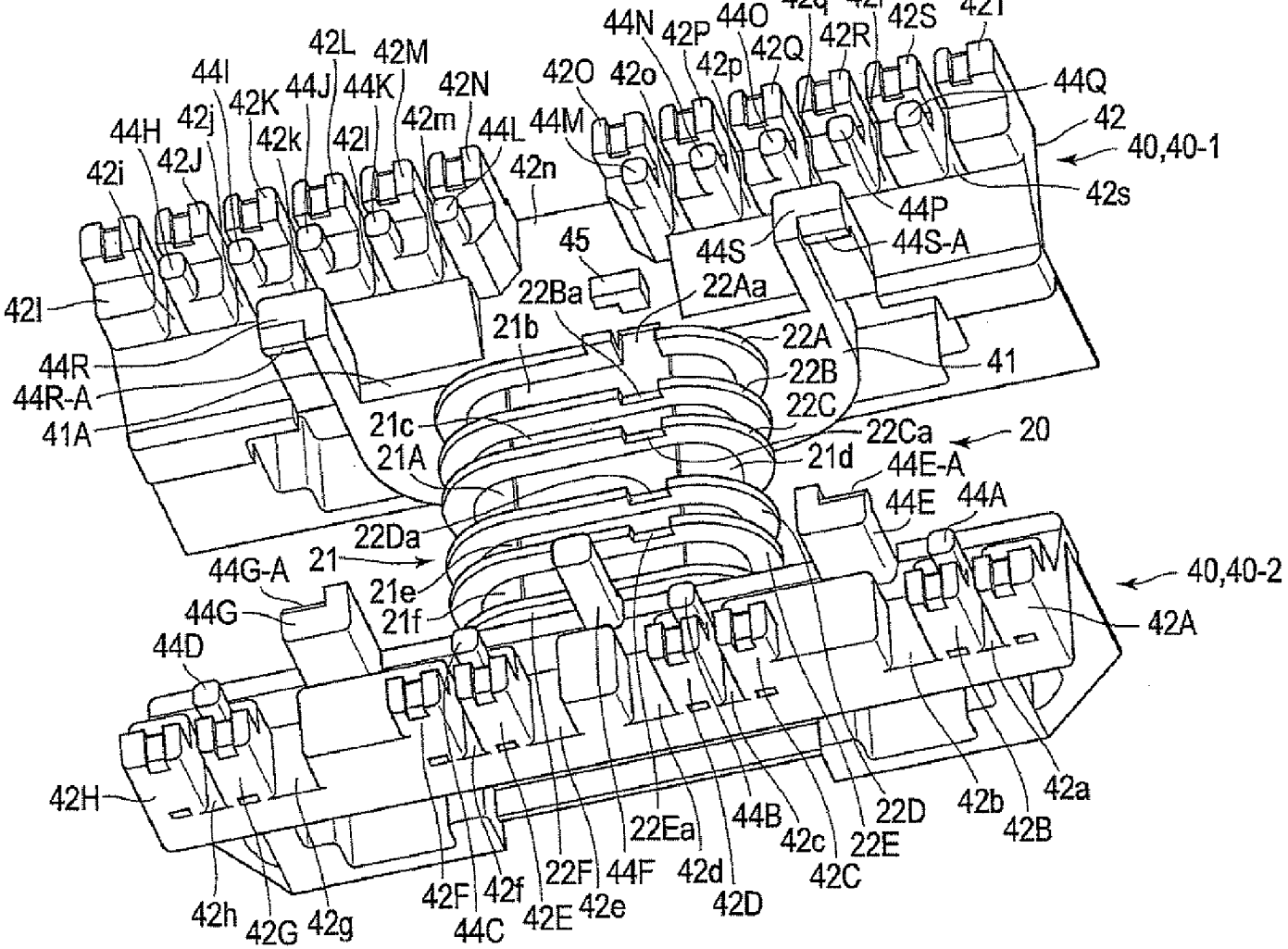
FIG. 3(*a*) is a bottom perspective view representing an inner cylinder part and a terminal base of the transformer according to the first embodiment.
Figure 3:
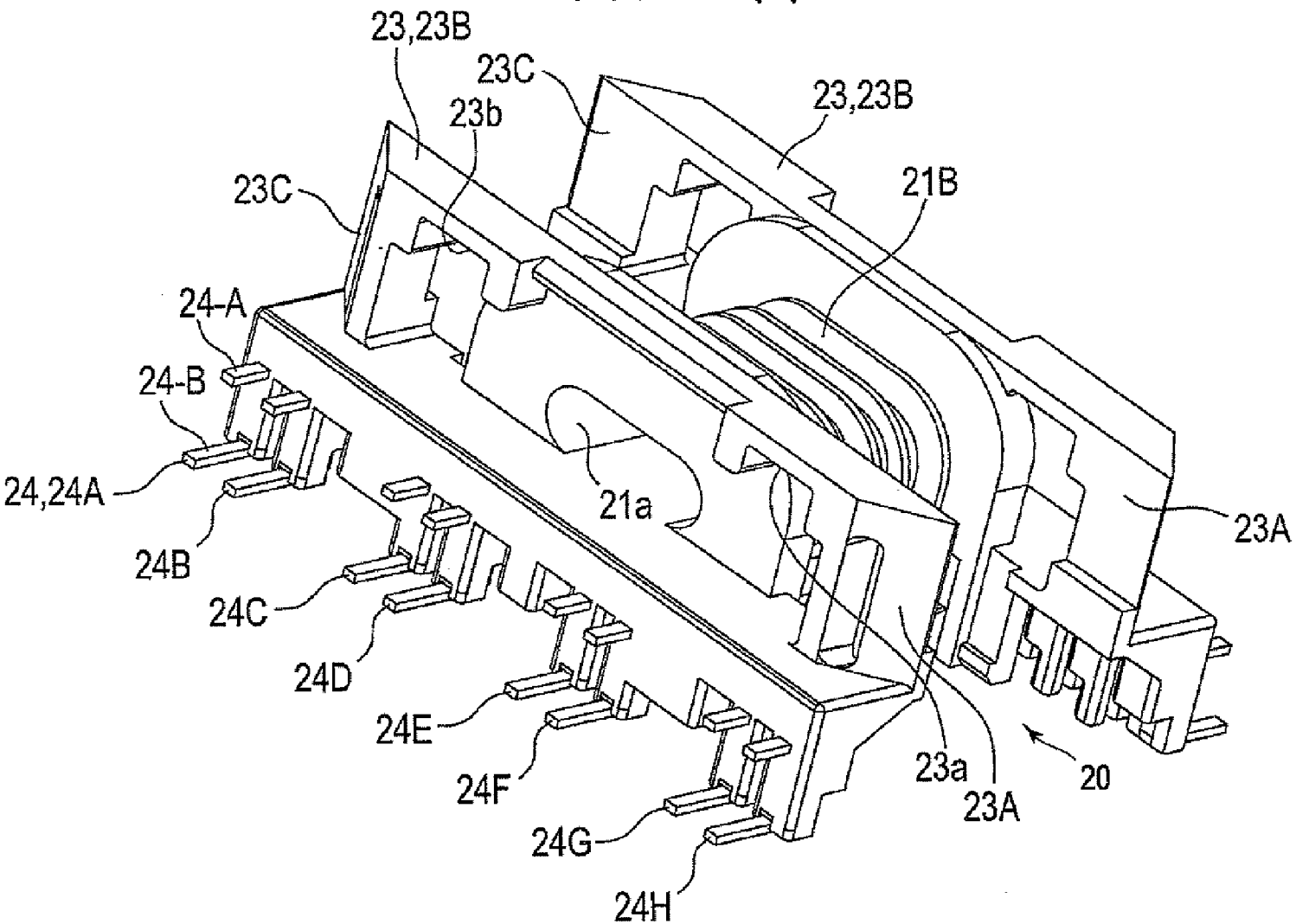
Figure 4:
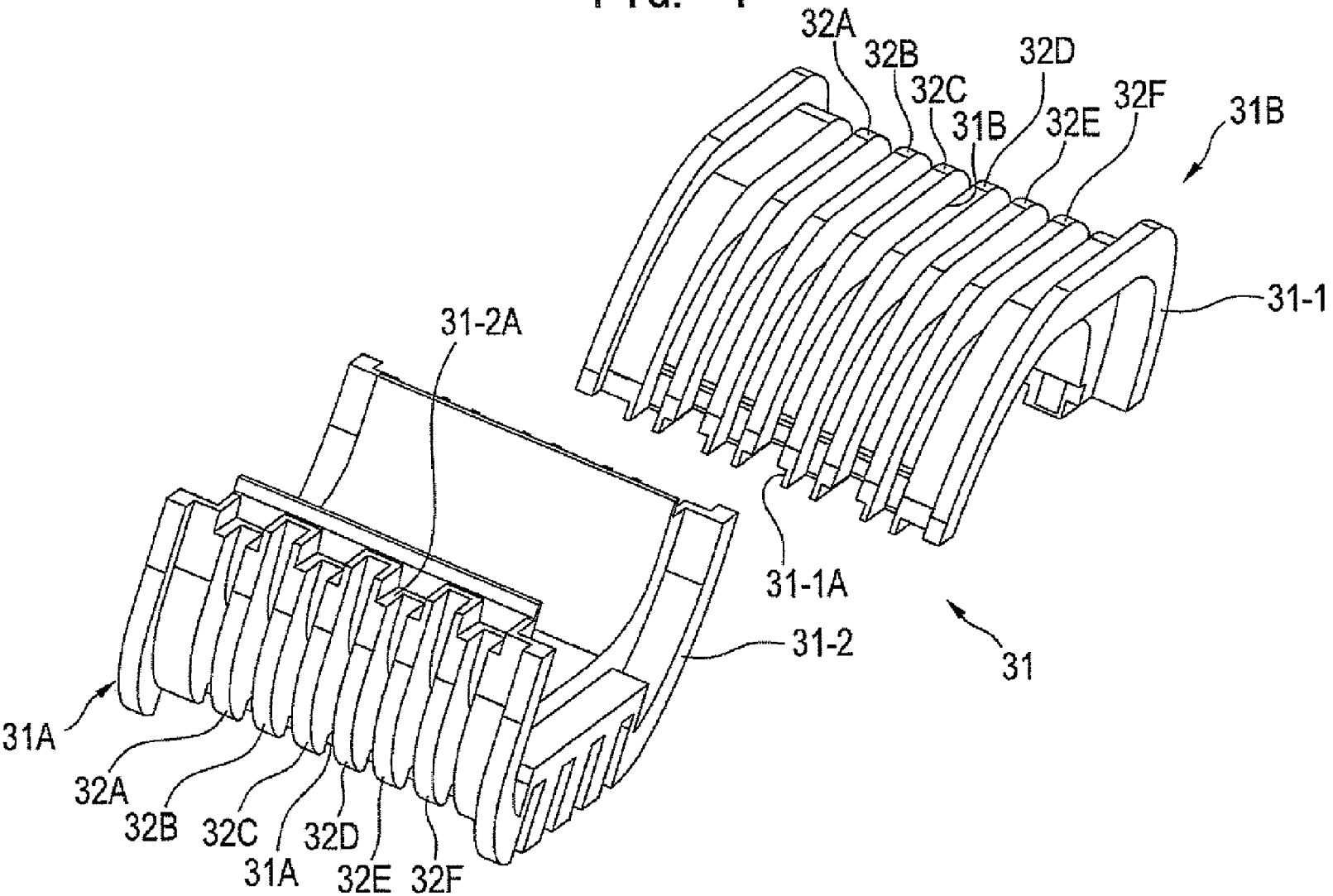
FIG. 4 is an exploded perspective view of an outer cylinder part of the transformer according to the first embodiment.
Figure 5:
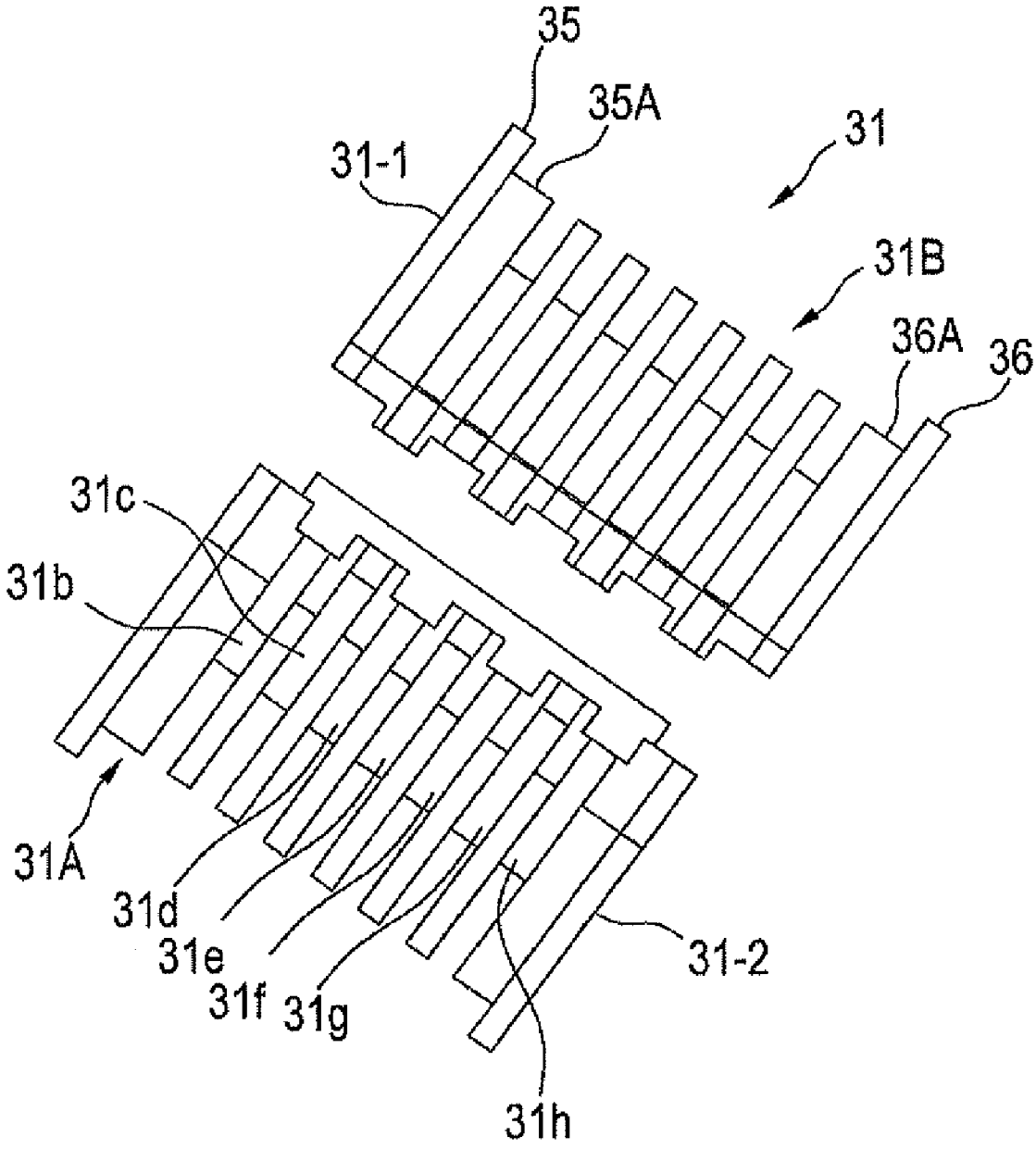
FIG. 5 is a side perspective view of the outer cylinder part of the transformer according to the first embodiment.
Figure 6:
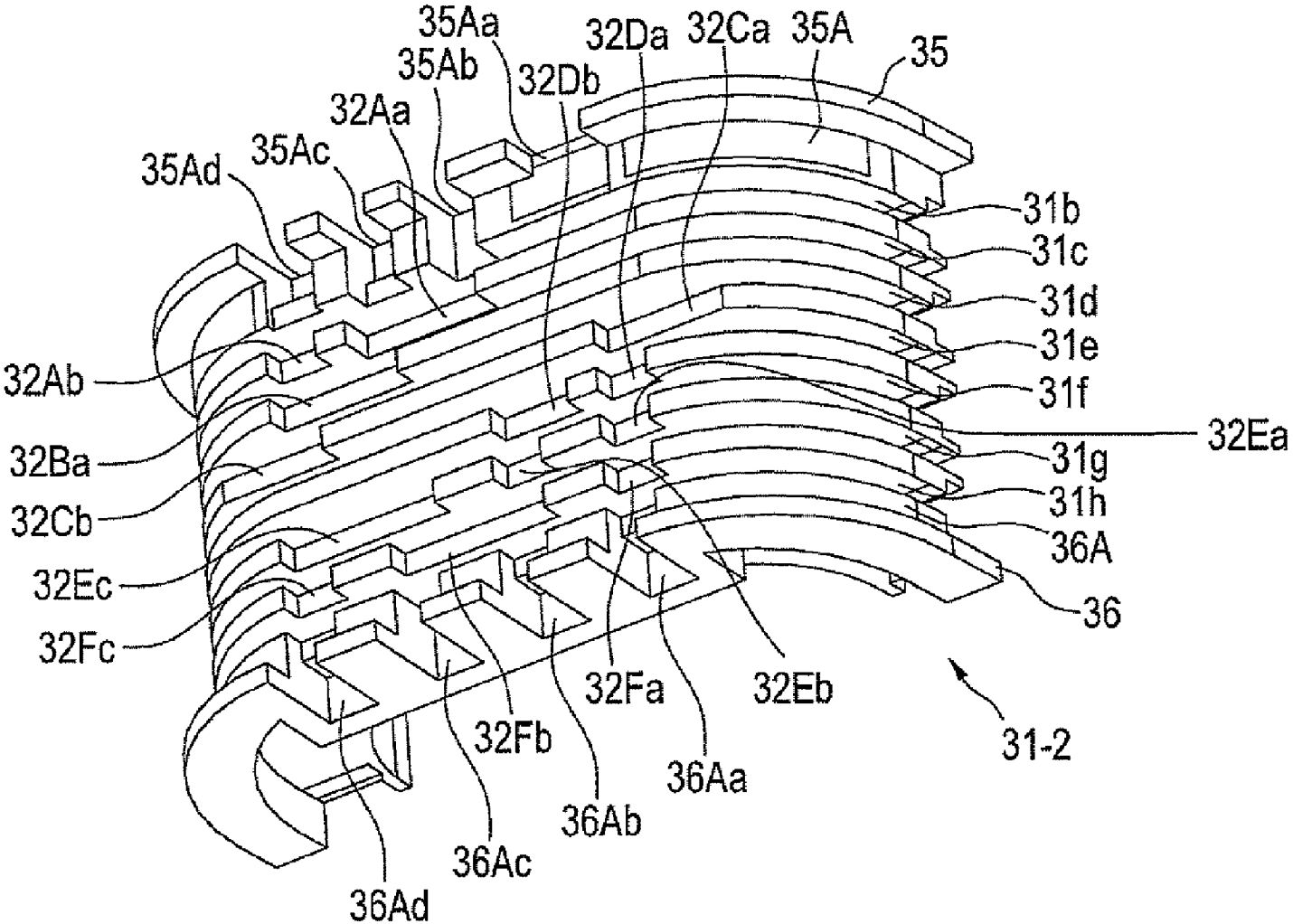
FIG. 6 is a perspective view of a mounting-board-side cylindrical division part of the outer cylinder part of the transformer according to the first embodiment.

The bobbin 20 includes an inner cylinder part 21 shown in FIGS. 3(*a*) and 3(*b*), and an outer cylinder part 31 shown in FIGS. 4 through 6. The inner cylinder part 21 is substantially cylindrical in shape and is formed of an insulating resin. A terminal base 40 is provided on each axial end of the inner cylinder part 21. The two terminal bases 40 will be distinguished as a terminal base 40-1 and a terminal base 40-2. The outer cylinder part 31 is formed of an insulating resin and is mounted around the outside of the inner cylinder part 21. The inner cylinder part 21 serves as a core portion, and the outer cylinder part 31 as a cover.

A cross section of the inner cylinder part 21 taken along a plane orthogonal to the axis of the inner cylinder part 21 has a substantially elliptical shape that includes a pair of linear parts arranged in parallel, and a pair of substantially arc-shaped parts provided one on each end of the pair of linear parts that connect like ends of the linear parts. The center wall parts of the cores 10 are inserted into a space 21*a* defined by the inner peripheral surface of the inner cylinder part 21 as show in FIG. 3(*b*). One of the parallel linear parts in the cross section of the inner cylinder part 21 is parallel to and positioned opposite a top surface of a mounting board (not shown) and serves as an inner mounting-board-opposing surface 21A (see FIG. 3(*a*)) that opposes the mounting board via an outer mounting-board-opposing surface 31A of the outer cylinder part 31 described later, while the other parallel linear part serves as an inner non-mounting-board-opposing surface 21B (see FIG. 3(*b*)).

Inner partitions 22A-22F are disposed on the peripheral surface of the inner cylinder part 21. As shown in FIG. 3(*a*), six plate-shaped inner partitions 22A-22F are erected on the peripheral surface of the inner cylinder part 21 and encircle the entire surface in the circumferential direction. The inner partitions 22A-22F partition the peripheral surface of the inner cylinder part 21 along the axial direction thereof into five sections. These sections will be referred to as a first section 21*b*, a second section 21*c*, a third section 21*d*, a fourth section 21*e*, and a fifth section 21*f* in order from top to bottom in FIG. 3(*a*). One of the wires 50 described later is wound in each of these sections. Thus, each section of the inner cylinder part 21 serves as a wire winding section.

Inner grooves 22Aa-22Ea are respectively formed in the inner partitions 22A-22E at positions forming a straight line along the axis of the inner cylinder part 21, i.e., in a straight line from one axial end of the inner cylinder part 21 through the fifth partition. The inner grooves 22Aa-22Ea are formed in the portion of the partitions positioned above the inner mounting-board-opposing surface 21A and recess inward along a radial direction of the inner cylinder part 21. Each of the inner grooves 22Aa-22Ea extends a prescribed distance in the circumferential direction of the inner cylinder part 21 from a center position of the respective inner partitions 22A-22E.

The terminal bases 40 are integrally provided on both axial ends of the inner cylinder part 21. Each of the terminal bases 40 has a flange part 41 formed of the same insulating resin as the inner cylinder part 21 and integrally connected to the respective inner partitions 22A and 22F provided on the corresponding axial ends of the inner cylinder part 21. The surface of the flange part 41 on the inner mounting-board-opposing surface 21A side is formed as a flat mounting-board-side surface 41A that is parallel to the inner mounting-board-opposing surface 21A. The mounting-board-side surface 41A of the flange part 41 does not protrude farther outward in the radial direction of the inner cylinder part 21 than the outer edges of the inner partitions 22A-22F formed on top of the inner mounting-board-opposing surface 21A.

Each of the terminal bases 40 has a terminal support part 42. The terminal support part 42 is connected primarily to the portion of the flange part 41 described above that does not protrude farther outward in the radial direction than the inner partitions 22A-22F. The terminal support part 42 is formed of the same insulating resin as the inner cylinder part 21. Each of the terminal support parts 42 extends in a direction orthogonal to the axis of the inner cylinder part 21 and parallel to the inner mounting-board-opposing surface 21A. The center parts of the terminal support parts 42 are integrally connected to the corresponding flange parts 41. The side of the terminal support part 42 nearest the inner non-mounting-board-opposing surface 21B with respect to the direction linking the inner mounting-board-opposing surface 21A to the inner non-mounting-board-opposing surface 21B will be referred to as the non-mounting-surface side, while the side of the terminal support part 42 nearest the inner mounting-board-opposing surface 21A will be referred to as the mounting-surface side.

As shown in FIG. 3(*b*), core support parts 23 are disposed on non-mounting-surface side portions of the terminal support part 42. Each core support part 23 includes a first extension part 23A extending outward from the surface of the terminal support part 42 on the non-mounting-surface side in a direction from the inner mounting-board-opposing surface 21A toward the inner non-mounting-board-opposing surface 21B; a non-mounting-surface parallel part 23B extending from the end of the respective first extension part 23A farthest from the terminal support part 42 and parallel to the inner mounting-board-opposing surface 21A and inner non-mounting-board-opposing surface 21B, with the center portion connected to a portion of the inner non-mounting-board-opposing surface 21B on one or the other end of the inner cylinder part 21; and a second extension part 23C extending from the end of the non-mounting-surface parallel part 23B farthest from the end connected to the first extension part 23A toward the non-mounting-surface side of the terminal support part 42 and connected to this surface of the terminal support part 42. With these components, the overall core support part 23 is substantially U-shaped.

One side wall part 10B of each core 10 is inserted into a space 23*a* defined by the first extension part 23A and non-mounting-surface parallel part 23B of the respective core support part 23 and the respective flange part 41 and terminal support part 42 as shown in FIG. 1. The other side all part 10B of each core 10 is inserted into a space 23*b* defined by the second extension part 230 and non-mounting-surface parallel part 23B of the respective core support part 23 and the respective flange part 41 and terminal support part 42.

A total of twenty metallic terminal electrodes 24 are disposed on the mounting-surface side of the terminal support part 42. Twelve of these terminal electrodes 24 are fixed to the terminal support part 42 of the terminal base 40-1 disposed on one axial end of the inner cylinder part 21 and are juxtaposed along the longitudinal direction of the terminal support part 42 in two sets of six, with the six terminal electrodes 24 of each set fixed at prescribed regular intervals in the longitudinal direction of the terminal support part 42. The gap formed between one set of the six terminal electrodes 24 and the other set is wider than this prescribed regular interval.

The remaining eight terminal electrodes 24 are fixed to the terminal support part 42 of the terminal base 40-2 provided on the other axial end of the inner cylinder part 21 and are juxtaposed in pairs along the longitudinal direction of the terminal support part 42, with a prescribed interval formed between the terminal electrodes 24 of each pair. A gap formed between each pair of terminal electrodes 24 is wider than the prescribed interval between the terminal electrodes 24 of each pair. Each of these terminal electrodes 24 includes two metal plate-shaped pieces that have been formed into a substantially L-shape, as will be described later, making the overall terminal electrode 24 substantially U-shaped. Specifically, the substantially U-shaped terminal electrode 24 has a first leg part 24-A and a second leg part 24-B (see FIG. 3(*b*)) arranged parallel to each other, and a coupling part (not shown) for coupling the base ends of the first leg part 24-A and second leg part 24-B. As shown in FIG. 3(*b*), the entire coupling part together with the base ends of the first leg part 24-A and second leg part 24-B connected by the coupling part are retained in the insulating resin material constituting the terminal support part 42. Thus, each terminal electrode 24 is supported and fixed by the terminal support part 42. The first leg parts 24-A of the terminal electrodes 24 are disposed on the non-mounting-surface side of the terminal support part 42, and one end of a wire 50 described later is electrically connected to each first leg part 24-A. The second leg parts 24-B are arranged parallel to the mounting surface of the mounting board and are electrically connected to a conductive pattern on this mounting surface. Interelectrode grooves 42*a*-42*s* are formed in the mounting surface side of the terminal support part 42 at positions between adjacent terminal electrodes 24 and have a prescribed depth in the direction from the mounting-surface side toward the non-mounting-surface side.

Figure 7:
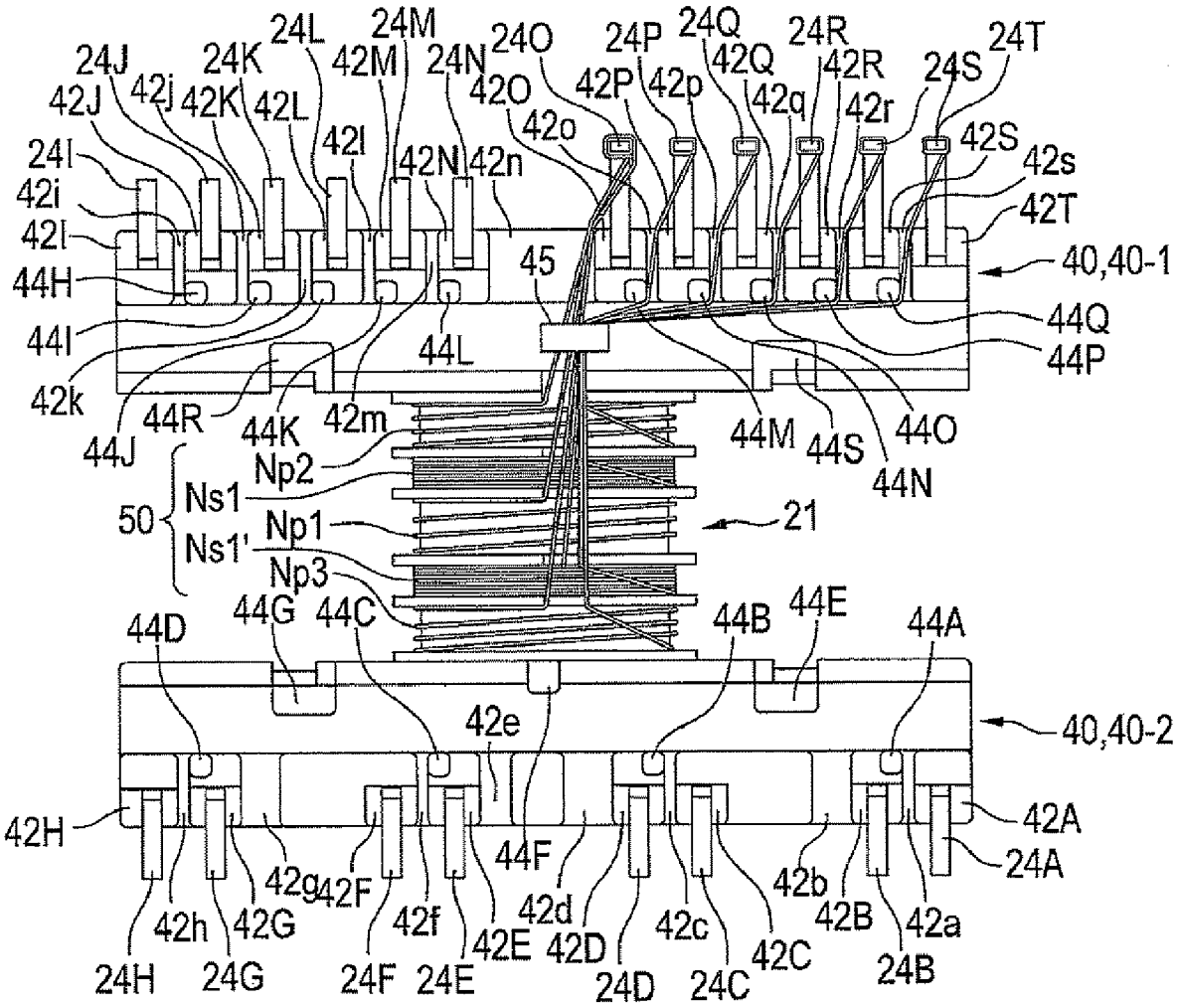
FIG. 7 is a bottom view of the transformer with winding a wire over the inner cylinder part according to the first embodiment.

As shown in FIG. 7, the eight terminal electrodes 24 on the terminal support part 42 provided in the terminal base 40-2 on the other axial end of the inner cylinder part 21 are, in order from right to left in FIG. 7, a first terminal 24A, a second terminal 24B, . . . , and an eighth terminal 24H. The twelve terminal electrodes 24 on the terminal support part 42 provided in the terminal base 40-1 on the first axial end of the inner cylinder part 21 are, in order from left to right in FIG. 7, a ninth terminal 24I, a tenth terminal 24J, . . . , and a twentieth terminal 24T. The terminal support parts 42 supporting the first terminal 24A, second terminal 24B, . . . , and twentieth terminal 24T have corresponding terminal support bases 42A, 42B, . . . , and 42T protruding toward the mounting-surface side.

Further, as shown in FIG. 3(*a*), the interelectrode grooves formed in the terminal base 40-2 are, in order from right to left in FIG. 3(*a*), the first interelectrode groove 42*a*, the second interelectrode groove 42*b*, and the eighth interelectrode groove 42*h*. The interelectrode grooves formed in the 40-1 are, in order from left to right in FIG. 3(*a*), the ninth interelectrode groove 42*i*, . . . , and the nineteenth interelectrode groove 42*s*.

Further, wire posts 44A-44S are integrally provided on the mounting-board-side surface 41A of the flange part 41, and some of the terminal support bases 42A-42T of the terminal support part 42 to which the terminal electrodes 24 are fixed. The wire posts 44A-44S are formed of the same insulating resin as the flange parts 41 and terminal support parts 42 and extend in a direction toward the mounting surface (not shown). Of the wire posts 44A-44S shown in FIG. 3(*a*), two are provided on the mounting-board-side surface 41A of the flange part 41 disposed in the terminal support part 42 of the terminal base 40-1 provided on one axial end of the inner cylinder part 21, while ten are provided on the mounting-surface side of the terminal base 40-1 near the portion of the terminal support part 42 on which the terminal electrodes 24 are fixed. Further, three of the wire posts 44A-44S are provided on the mounting-board-side surface 41A of the flange part 41 disposed in the terminal support part 42 of the terminal base 40-2 provided on the other axial end of the inner cylinder part 21, while four are provided on the mounting-surface side of the terminal base 40-2 near the portion of the terminal support part 42 on which the terminal electrodes 24 are fixed.

Specifically, as shown in FIG. 3(*a*), the wire posts provided on the terminal support part 42 of the terminal base 40-2 disposed on the other axial end of the inner cylinder part 21 are, in order from right to left in FIG. 3(*a*), a first wire post 44A, a second wire post 44B, a third wire post 44C, and a fourth wire post 44D (a total of four), as well as a fifth wire post 44E, a sixth wire post 44F, and a seventh wire post 44G (a total of three). The wire posts provided on the terminal support part 42 of the terminal base 40-1 disposed on the first axial end of the inner cylinder part 21 are, in order from left to right in FIG. 3, an eighth wire post 44H, a ninth wire post 44I, . . . , and a seventeenth wire post 44Q (a total of ten), as well as an eighteenth wire post 44R and a nineteenth wire post 44S (a total of two).

The first wire post 44A is disposed near the second terminal 24B, and the second wire post 44B is disposed near the fourth terminal 24D. The third wire post 44C is disposed near the fifth terminal 24E, and the fourth wire post 44D is disposed near the seventh terminal 24G. The fifth wire post 44E is disposed on the right end in FIG. 3(*a*) of the flange part 41 of the other axial end of the inner cylinder part 21 with respect to the longitudinal direction of the terminal support part 42. The sixth wire post 44F is disposed in a center position of the inner mounting-board-opposing surface 21A with respect to the circumferential direction of the inner cylinder part 21. The seventh wire post 44G is disposed on the left end in FIG. 3(*a*) of the flange part 41 of the other end of the inner cylinder 21 with respect to the longitudinal direction of the terminal support part 42.

The eighth wire post 44H is disposed near the tenth terminal 24J, and the ninth wire post 44I is disposed near the eleventh terminal 24K. The ninth wire post 44I is disposed near the eleventh terminal 24K. The tenth wire post 44J is disposed near the twelfth terminal 24L, and the eleventh wire post 44K is disposed near the thirteenth terminal 24M. The twelfth wire post 44L is disposed near the fourteenth terminal 24N, and the thirteenth wire post 44M is disposed near the fifteenth terminal 24O. The fourteenth wire post 44N is disposed near the sixteenth terminal 24P, and the fifteenth wire post 44O is disposed near the seventeenth terminal 24Q. The sixteenth wire post 44P is disposed near the eighteenth terminal 24R, and the seventeenth wire post 44Q is disposed near the nineteenth terminal 24S.

The eighteenth wire post 44R is disposed on the left end in FIG. 3(*a*) of the flange part 41 of the first axial end of the inner cylinder part 21 relative to the longitudinal direction of the terminal support part 42 on the terminal base 40-1. The nineteenth wire post 44S is disposed on the right end in FIG. 3(*a*) of the flange part 41 of the first axial end of the inner cylinder part 21 relative to the longitudinal direction of the terminal support part 42.

As shown in FIG. 3(*a*), a hook receiving part 44E-A is provided on the surface of the fifth wire post 44E opposing the nineteenth wire post 44S, a hook receiving part 44G-A is provided on the surface of the seventh wire post 44G opposing the eighteenth wire post 44R, a hook receiving part 44R-A is provided on the surface of the eighteenth wire post 44R opposing the seventh wire post 44G, and a hook receiving part 44S-A is provided on the surface of the nineteenth wire post 44S opposing the fifth wire post 44E. The hook receiving parts 44E-A, 44G-A, 44R-A, and 44S-A can engage with hooks 91A of the casing 91 described later.

As shown in FIG. 3(*a*), one end of a hook part 45 is supported on top of the terminal base 40-1, and specifically on the surface expanded from the fourteenth interelectrode groove 42*n*. The hook part 45 protrudes outward from this expanded surface in the radial direction of the inner cylinder part 21. The distal end portion of the hook part 45 is bent to form an L-shape. The hook part 45 is positioned substantially along an extension of a straight line passing through the inner grooves 22Aa-22Ea so that a portion of the hook part 45 overlaps the opening in the inner groove 22Aa when the hook part 45 is viewed along the axial direction of the inner cylinder part 21. The distance from the surface expanded from the fourteenth interelectrode groove 42*n* to the bent portion of the hook part 45 is set less than the height of the inner partitions 22A-22F erected from the inner cylinder part 21.

As will be described later in greater detail, the outer cylinder part 31 shown in FIG. 4 is formed in halves. As a whole, the outer cylinder part 31 has a cylindrical shape that substantially resembles the shape of the inner cylinder part 21, but with a larger diameter. Thus, a cross section of the outer cylinder part 31 taken along a plane orthogonal to the axis of the same has substantially an elliptical shape that includes a pair of linear parts arranged in parallel, and a pair of substantially arc-shaped parts provided one on each end of the pair of linear parts that connect like ends of the linear parts. The inner cylinder part 21 is disposed in a space defined by the inner peripheral surface of the outer cylinder part 31. One of the parallel linear parts in the cross section of the outer cylinder part 31 is parallel to and opposes the top surface of the mounting board and serves as an outer mounting-board-opposing surface 31A, while the other parallel linear part serves as an outer non-mounting-board-opposing surface 31B.

Outer partitions 32A-32F are provided on the outer peripheral surface of the outer cylinder part 31. As shown in FIGS. 4 and 5, the six outer partitions 32A-32F are plate-shaped members erected from the outer peripheral surface of the outer cylinder part 31 and encircle the entire surface in the circumferential direction. However, the protruding height of the outer partitions 32A-32F in a radial direction of the outer cylinder part 31 is not constant over the entire circumference of the outer cylinder part 31. Specifically, the protruding height of the outer partitions 32A-32F positioned on the outer mounting-board-opposing surface 31A is greater than the protruding height of the same positioned on the outer non-mounting-board-opposing surface 31B.

As shown in FIG. 5, the outer partitions 32A-32F partition the peripheral surface of the outer cylinder part 31 along the axial direction thereof into seven sections. One wire described later is wound about each section. In addition, outer flanges 35 and 36 are provided on both axial ends of the outer cylinder part 31 and protrude outward. The axial ends of the outer cylinder part on which the outer flanges 35 and 36 are provided constitute flange base parts 35A and 36A. Together with the first and sixth partitions (i.e., the outer partitions 32A and 32F), the flange base parts 35A and 36A function to define sections between other adjacent partitions. The sections shown in FIG. 6, in order from top to bottom, are a first section 31*b*, a second section 31*c*, . . . , and a seventh section 31*h*.

As shown in FIG. 6, a first notch 35Aa, a second notch 35Ab, a third notch 35Ac, and a fourth notch 35Ad are formed in the outer flange 35 on the outer mounting-board-opposing surface 31A side and are spaced at intervals. Of the four notches, the depth of the first notch 35Aa inward along a radial direction of the outer cylinder part 31 is such that the bottom surface of the first notch 35Aa is substantially flush with the protruding ends of the outer partitions 32A-32F.

The second notch 35Ab has the greatest depth inward along a radial direction of the outer cylinder part 31 among all notches formed in the outer cylinder part 31 such that the bottom surface of the second notch 35Ab is positioned near the peripheral surface of the outer cylinder part 31 on which each section is defined. The second notch 35Ab is formed not only in the outer flange 35, but also in a portion of the flange base part 35A to which the outer flange 35 is connected so as to communicate with the first section 31*b* (see FIG. 5). The third notch 35Ac and fourth notch 35Ad are formed at a similar depth to the second notch 35Ab, so that the bottom surfaces of these notches are positioned nearest the peripheral surface of the outer cylinder part 31 defining the bottom surfaces of the sections. As with the second notch 35Ab described above, the third notch 35Ac and fourth notch 35Ad also extend to a portion of the flange base part 35A and are in communication with the first section 31*b*. However, in the portion of the flange base part 35A, the third notch 35Ac is formed at a shallower depth than the second notch 35Ab and has the second greatest depth among all notches formed in the outer cylinder part 31, while the fourth notch 35Ad is formed shallower than the third notch 35Ac in the portion of the flange base plate 35A and has the third greatest depth among all notches formed in the outer cylinder part 31.

A first outer groove 32Aa and a second outer groove 32Ab are formed inward along a radial direction of the outer cylinder part 31 in portions of the first outer partition 32A positioned nearest the outer mounting-board-opposing surface 31A in the axial direction of the outer cylinder part 31. The first outer groove 32Aa is formed across a region opposing the second notch 35Ab and third notch 35Ac in the axial direction of the outer cylinder part 31 and has the second greatest depth described above. The second outer groove 32Ab is formed across a region opposing the fourth notch 35Ad in the axial direction of the outer cylinder part 31 and has the third greatest depth described above.

A third outer groove 32Ba is formed inward along a radial direction of the outer cylinder part 31 in a portion of the second outer partition 32B from the outer mounting-board-opposing surface 31A in the axial direction of the outer cylinder part 31. The third outer groove 32Ba is formed across a region opposing the third notch 35Ac and fourth notch 35Ad in the axial direction of the outer cylinder part 31 and has the third greatest depth.

A fourth outer groove 32Ca and a fifth outer groove 32Cb are formed inward along a radial direction of the outer cylinder part 31 in portions of the third outer partition 32C from the outer mounting-board-opposing surface 31A in the axial direction of the outer cylinder part 31. The fourth outer groove 32Ca extends rightward in FIG. 6 from a position opposing the right edge of the first notch 35Aa in the axial direction of the outer cylinder part 31 and is parallel to the outer mounting-board-opposing surface 31A (see FIG. 4). The fourth outer groove 32Ca has the third greatest depth. The fifth outer groove 32Cb extends leftward in FIG. 6 from a position opposing the right edge of the fourth notch 35Ad in the axial direction of the outer cylinder part 31 and is parallel to the outer mounting-board-opposing surface 31A. The fifth outer groove 32Cb has the third greatest depth.

A sixth outer groove 32Da and a seventh outer groove 32Db are formed inward along a radial direction of the outer cylinder part 31 in portions of the fourth outer partition 32D from the outer mounting-board-opposing surface 31A in the axial direction of the outer cylinder part 31. The sixth outer groove 32Da is formed in a region opposing the right edge of the first notch 35Aa in FIG. 6 along the axial direction of the outer cylinder part 31 and has the third greatest depth. The seventh outer groove 32Db extends leftward in FIG. 6 a prescribed distance from a position opposing the right edge of the first notch 35Aa and has the third greatest depth.

An eighth outer groove 32Ea, a ninth outer groove 32Eb, and a tenth outer groove 32Ec are formed inward along a radial direction of the outer cylinder part 31 in portions of the fifth outer partition 32E from the outer mounting-board-opposing surface 31A along the axial direction of the outer cylinder part 31. The eighth outer groove 32Ea is formed in a region opposing the sixth outer groove 32Da in the axial direction of the outer cylinder part 31 and has the third greatest depth. The ninth outer groove 32Eb is formed in a region opposing the left side in FIG. 6 of the seventh outer groove 32Db in the axial direction of the outer cylinder part 31 and has the third greatest depth. The tenth outer groove 32Ec extends from the left edge in FIG. 6 of the second notch 35Ab across a region opposing the fourth notch 35Ad in the axial direction of the outer cylinder part 31 and has the third greatest depth.

An eleventh outer groove 32Fa, a twelfth outer groove 32Fb, and a thirteenth outer groove 32Fc are formed inward along a radial direction of the outer cylinder part 31 in portions of the sixth outer partition 32F from the outer mounting-board-opposing surface 31A in the axial direction of the outer cylinder part 31. The eleventh outer groove 32Fa is formed in a region opposing the sixth outer groove 32Da in the axial direction of the outer cylinder part 31 and has the third greatest depth. The twelfth outer groove 32Fb extends from a position opposing the ninth outer groove 32Eb in the axial direction of the outer cylinder part 31 to a position opposing the left edge in FIG. 6 of the third notch 35Ac and has the third greatest depth. The thirteenth outer groove 32Fc is formed in a region opposing the fourth notch 35Ad in the axial direction of the outer cylinder part 31 and has the third greatest depth.

In the outer flange 36 provided on the other axial end of the outer cylinder part 31 above the outer mounting-board-opposing surface 31A are formed four notches spaced at intervals along the outer flange 36, and specifically a first notch 36Aa, a second notch 36Ab, a third notch 36Ac, and a fourth notch 36Ad. The first notch 36Aa is formed in the outer flange 36 at a position opposing the sixth outer groove 32Da in the axial direction of the outer cylinder part 31 and has a depth substantially equivalent to that of the second notch 35Ab (the greatest depth). The first notch 36Aa is formed not only in the outer flange 36, but extends to a portion of the flange base part 36A connected to the outer flange 36. While in communication with the seventh section 31*h* (see FIG. 5), the first notch 36Aa becomes shallower in the portion of the flange base part 36A and has the third greatest depth.

The second notch 36Ab is formed in a region opposing the ninth outer groove 32Eb in the axial direction of the outer cylinder part 31 and has a depth similar to that of the second notch 35Ab. The second notch 36Ab is formed not only in the outer flange 36, but extends also to a portion of the flange base part 36A connected to the outer flange 36. While in communication with the seventh section 31*h*, the second notch 36Ab is formed shallower in the portion of the flange base part 36A and has the third greatest depth.

The third notch 36Ac is formed in a region opposing the right edge in FIG. 6 of the tenth outer groove 32Ec and the left edge in FIG. 6 of the twelfth outer groove 32Fb with respect to the axial direction of the outer cylinder part 31 and has a depth similar to that of the second notch 35Ab. The third notch 36Ac is formed not only in the outer flange 36, but extends to the flange base part 36A and is in communication with the seventh section 31*h*.

The fourth notch 36Ad is formed in a region opposing the thirteenth outer groove 32Fc in the axial direction of the outer cylinder part 31 and has a depth similar to that of the third notch 36Ac. The fourth notch 36Ad is formed not only in the outer flange 36, but extends also to a portion of the flange base part 36A. Although in communication with the seventh section 31*h*, the fourth notch 36Ad is formed shallower in the portion of the flange base part 36A and has the third greatest depth.

As described earlier, the outer cylinder part is formed of two halves that appear to be cut along division surfaces 31-1A and 31-2A extending substantially in a direction for joining together the sections 31*b*-31*h* of the two halves respectively parallel and adjacent to the inner mounting-board-opposing surface 21A and inner non-mounting-board-opposing surface 21B of the inner cylinder part 21. The two halves of the outer cylinder part 31 are an outer non-mounting-board-side cylindrical division part 31-1 and an outer mounting-board-side cylindrical division part 31-2. More specifically, as shown in FIGS. 4-6, the division surfaces 31-1A and 31-2A are formed in the shape of a square wave, i.e., a zigzag shape, producing a step in each partition. Hence, the outer non-mounting-board-side cylindrical division part 31-1 and outer mounting-board-side cylindrical division part 31-2 interlock at the division surfaces 31-1A and 31-2A. This construction makes it possible to increase the contact surface of the two halves between adjacent sections 31*b*-31*h* to a length greater than the thickness of the partitions, thereby achieving a prescribed creepage distance without increasing the thickness of the outer partitions 32A-32F.

After the wires 50 described later are wound about the outer cylinder part 31, an insulating tape 93 (see FIG. 15) is wound around the outer cylinder part 31 in a circumferential direction thereof. Subsequently, a fourth primary coil Np4 described later is wound over the top of the insulating tape 93, and another insulating tape 94 (see FIG. 16) is wound over the top of the fourth primary coil Np4.

As described earlier with reference to FIG. 1, the casing 90 includes a mounting-surface-side casing 91 and a non-mounting-surface side casing 92, each of which has a substantially rectangular shape. Four each of hooks 91A and 92A are provided one near each of the four corners of the casings 91 and 92, respectively, and protrude outward at a normal to the surface thereof. The hooks 91A provided on the mounting-surface-side casing 91 can engage with the hook receiving parts 44E-A, 44G-A, 44R-A, and 44S-A (see FIG. 3(*a*)) of the respective fifth wire post 44E, seventh wire post 44G, eighteenth wire post 44R, and nineteenth wire post 44S. The hooks 92A provided on the non-mounting-surface side casing 92 can engage with the non-mounting-surface parallel parts 23B (see FIG. 3(*b*)). The non-mounting-surface side casing 92 can be held by a suction nozzle of an automated machine (not shown).

Figure 10:
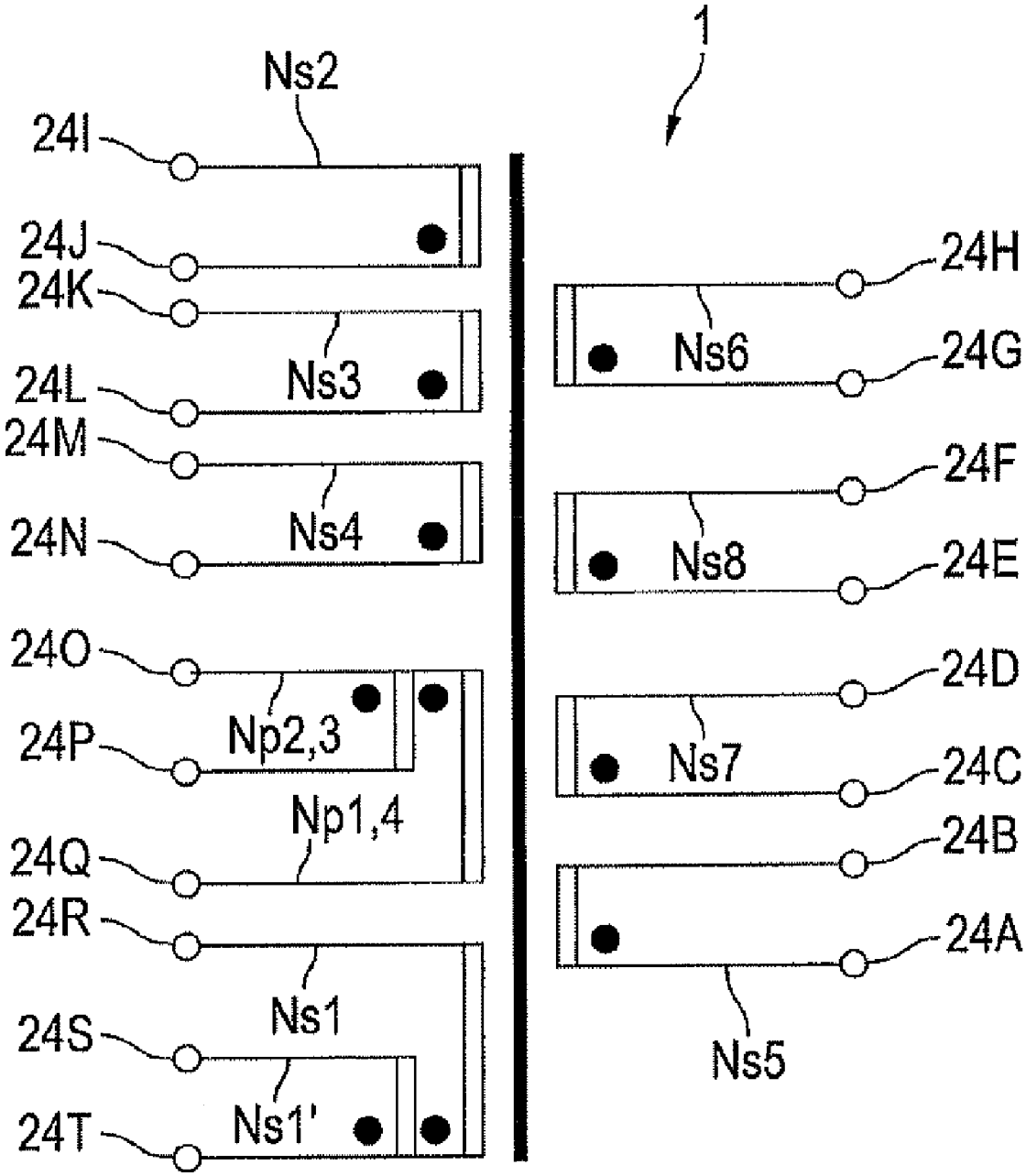
FIG. 10 is a schematic circuit diagram of the transformer according to the first embodiment.
Figure 11:
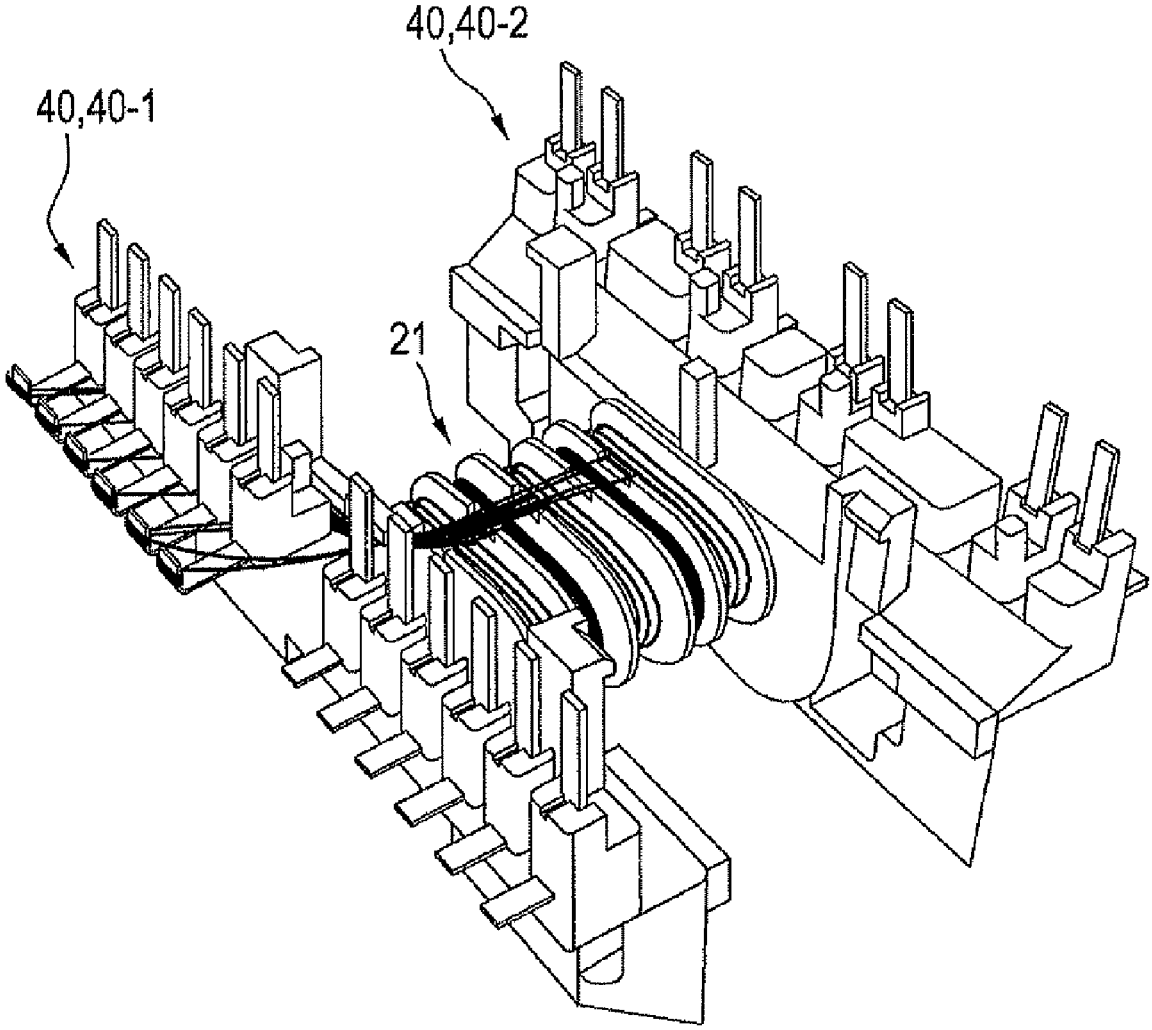
FIG. 11 is a bottom perspective view of transformer with winding the wire over the inner cylinder part during a manufacturing process according to the first embodiment.

The wires 50 are copper wires with an insulating coating. As shown in FIG. 10, the wires 50 include a first primary coil Np1, a second primary coil Np2, a third primary coil Np3, a fourth primary coil Np4, drive windings Ns1 and Ns1', a second secondary coil Ns2, a third secondary coil Ns3, a fourth secondary coil Ns4, a fifth secondary coil Ns5, a sixth secondary coil Ns6, a seventh secondary coil Ns7, and an eighth secondary coil Ns8. The first primary coil Np1, second primary coil Np2, third primary coil Np3, and fourth secondary coil Ns4 each has a wire diameter of 0.2 mm, while the remaining wires 50 each has a wire diameter of 0.12 mm. In the order described below, a machine automatically anchors one end of each wire 50 to a corresponding terminal electrode 24, winds the wire 50 about the corresponding section, and anchors the other end to another terminal electrode 24.

More specifically, as shown in FIGS. 7 and 10, the first primary coil Np1 is electrically connected at one end to the fifteenth terminal 24O, routed around the side surface of the terminal support base 42O supporting the fifteenth terminal 24O, passed through the fourteenth interelectrode groove 42*n*, hooked over the hook part 45, sequentially routed through the inner groove 22Aa, inner groove 22Ba, and inner groove 22Ca, and wound about the third section 21*d* of the inner cylinder part 21 (see FIG. 3(*a*)). After being wound about the third section 21*d*, the first primary coil Np1 is routed sequentially back through the inner groove 22Ca, inner groove 22Ba, and inner groove 22Aa, hooked over the hook part 45, routed around the fourteenth wire post 44N, passed through the sixteenth interelectrode groove 42*p*, routed around the side surface of the terminal support base 42Q supporting the seventeenth terminal 24Q, and electrically connected at the other end to the seventeenth terminal 24Q.

The second primary coil Np2 is electrically connected at one end to the fifteenth terminal 24O, routed around the side surface of the terminal support base 42O supporting the fifteenth terminal 24O, passed through the fourteenth interelectrode groove 42*n*, hooked over the hook part 45, passed through the inner groove 22Aa, and wound about the first section 21*b* of the inner cylinder part 21 (see FIG. 3(*a*)). After being wound about the first section 21*b*, the second primary coil Np2 is routed back through the inner groove 22Aa, hooked over the hook part 45, routed around the thirteenth wire post 44M, passed through the fifteenth interelectrode groove 42*o*, routed around the side surface of the terminal support base 42P supporting the sixteenth terminal 24P, and electrically connected at the other end to the sixteenth terminal 24P.

The third primary coil Np3 is electrically connected at one end to the fifteenth terminal 24O, routed around the side surface of the terminal support base 42O supporting the fifteenth terminal 24O, passed through the fourteenth interelectrode groove 42*n*, hooked over the hook part 45, passed sequentially through the inner groove 22Aa, inner groove 22Ba, inner groove 22Ca, inner groove 22Da, and inner groove 22Ea, and wound about the fifth section 21*f* of the inner cylinder part 21 (see FIG. 3(*a*)). After being wound about the fifth section 21*f*, the third primary coil Np3 is sequentially passed back through the inner groove 22Ea, inner groove 22Da, inner groove 22Ca, inner groove 225*a*, and inner groove 22Aa, hooked over the hook part 45, routed around the thirteenth wire post 44M, passed through the fifteenth interelectrode groove 42*o*, routed around the side surface of the terminal support base 42P supporting the sixteenth terminal 24P, and electrically connected at the other end to the sixteenth terminal 24P.

The drive winding Ns1 is electrically connected at one end to the eighteenth terminal 24R, routed around the side surface of the terminal support base 42R supporting the eighteenth terminal 24R, passed through the seventeenth interelectrode groove 42*q*, routed around the fifteenth wire post 44O, hooked over the hook part 45, passed sequentially through the inner groove 22Aa and inner groove 22Ba, and wound about the second section 21*c* of the inner cylinder part 21 (see FIG.

3(*a*)). After being wound about the second section 21*c*, the drive winding Ns1 is passed sequentially back through the inner groove 22Ba and inner groove 22Aa, hooked over the hook part 45, routed around the seventeenth wire post 44Q, passed through the nineteenth interelectrode groove 42*s*, routed around the side surface of the terminal support base 42T supporting the twentieth terminal 24T, and electrically connected at the other end to the twentieth terminal 24T.

The drive winding Ns1' is electrically connected at one end to the nineteenth terminal 24S, routed around the side surface of the terminal support base 42S supporting the nineteenth terminal 24S, passed through the eighteenth interelectrode groove 42*r*, routed around the sixteenth wire post 44P, hooked over the hook part 45, sequentially passed through the inner groove 22Aa, inner groove 225*a*, inner groove 22Ca, and inner groove 22Da, and wound about the fourth section 21*e* of the inner cylinder part 21 (see FIG. 3(*a*)). After being wound about the fourth section 21*e*, the drive winding Ns1' is passed sequentially back through the inner groove 22Da, inner groove 22Ca, inner groove 22Ba, and inner groove 22Aa, hooked over the hook part 45, routed around the seventeenth wire post 44Q, passed through the nineteenth interelectrode groove 42*s*, routed around the side surface of the terminal support base 42T supporting the twentieth terminal 24T, and electrically connected at the other end to the twentieth terminal 24T.

Figure 9:
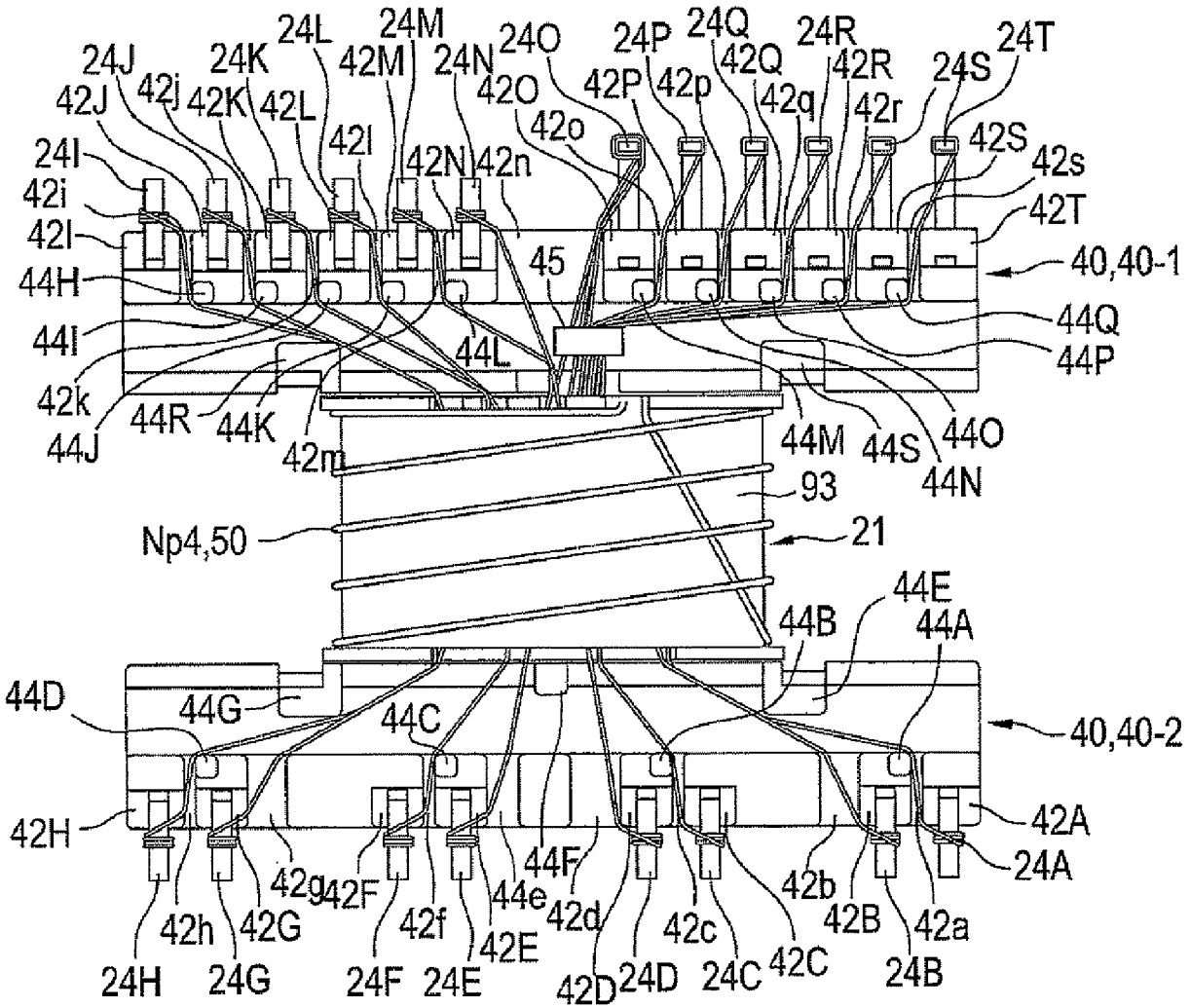
FIG. 9 is a bottom view of the transformer with winding the wire over the outer cylinder part after winding an insulating tape thereover according to the first embodiment.

After the wires 50 are wound about the outer cylinder part 31 and the insulating tape 93 is wound over the outer cylinder part 31, as will be described later, the fourth primary coil Np4 is wound about the insulating tape 93 (see FIG. 9). Specifically, the fourth primary coil Np4 is electrically connected at one end to the fifteenth terminal 24O, routed around the side surface of the terminal support base 42O supporting the fifteenth terminal 24O, passed through the fourteenth interelectrode groove 42*n*, and wound about the insulating tape 93. After being wound about the insulating tape 93, the fourth primary coil Np4 is routed around the fourteenth wire post 44N, passed through the sixteenth interelectrode groove 42*p*, routed around the side surface of the terminal support base 42Q supporting the seventeenth terminal 24Q, and electrically connected at the other end to the seventeenth terminal 24Q.

As described above, all primary coils wound about the inner cylinder part 21 are hooked over the hook part 45 provided between the terminals and the inner cylinder part 21 and electrically connected to their respective terminals, thereby preventing the lead ends of the primary coils from projecting outward between the inner cylinder part 21 and their respective terminals. Further, the primary coils wound about their respective sections are passed through all grooves present between their respective sections and the hook part 45 and are hooked around the hook part 45, thereby preventing the primary coils from coming out of the grooves. Since the hook part 45 restricts each primary coil from rising upward between the inner cylinder part 21 and the respective terminal, primary coils that were wound previously do not interfere with other primary coils being routed subsequently, thereby improving the efficiency of the machine-automated operation.

Figure 8:
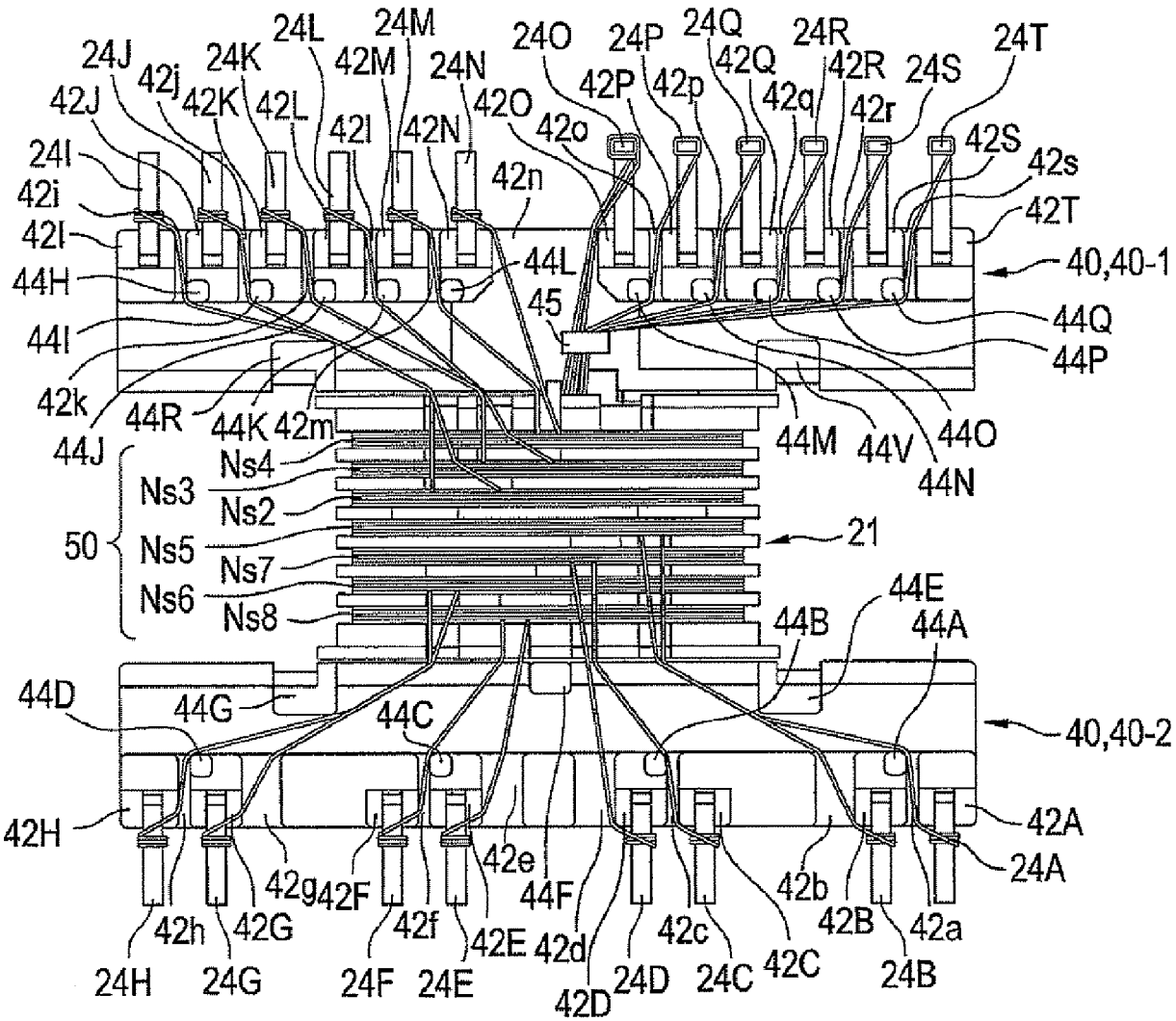
FIG. 8 is a bottom view of the transformer with winding the wire over the outer cylinder part according to the first embodiment.

As shown in FIGS. 8 and 10, the second secondary coil Ns2 is electrically connected at one end to the ninth terminal 24I, routed around the side surface of the terminal support base 42I supporting the ninth terminal 24I, passed through the ninth interelectrode groove 42*i*, routed around the eighth wire post 44H, routed around the eighteenth wire post 44R, sequentially passed through the fourth notch 35Ad of the outer flange 35, the second outer groove 32Ab of the first outer partition 32A from the outer flange 35 in the axial direction of the outer cylinder part 31, and the third outer groove 32Ba formed in the second outer partition 32B from the outer flange 35 (see FIG. 6), and wound about the third section 31*d* of the outer cylinder part 31 (see FIG. 5). The remainder of the second secondary coil Ns2 is run from the wound portion, sequentially passed through the third outer groove 32Ba, the second outer groove 32Ab, and the fourth notch 35Ad, routed around the eighteenth wire post 44R, routed around the ninth wire post 44I, passed through the tenth interelectrode groove 42*j*, routed around the side surface of the terminal support base 42J supporting the tenth terminal 24J, and electrically connected at the other end to the tenth terminal 24J.

The third secondary coil Ns3 is electrically connected at one end to the eleventh terminal 24K, routed around the side surface of the terminal support base 42K supporting the eleventh terminal 24*k*, passed through the eleventh interelectrode groove 42*k*, routed around the tenth wire post 44J, sequentially passed through the third notch 35Ac formed in the outer flange 35 and the first outer groove 32Aa of the first outer partition 32A from the outer flange 35 in the axial direction of the outer cylinder part 31, and wound about the second section 31*c* of the outer cylinder part 31 (see FIG. 5). The remainder of the third secondary coil Ns3 is run from this wound portion, sequentially passed back through the first outer groove 32Aa and third notch 35Ac, routed around the eleventh wire post 44K, passed through the twelfth interelectrode groove 42*l*, routed around the side surface of the terminal support base 42L supporting the twelfth terminal 24L, and electrically connected at the other end to the twelfth terminal 24L.

The fourth secondary coil Ns4 is electrically connected at one end to the thirteenth terminal 24M, routed around the side surface of the terminal support base 42M supporting the thirteenth terminal 24M, passed through the thirteenth interelectrode groove 42*m*, routed around the twelfth wire post 44L, passed through the second notch 35Ab of the outer flange 35, and wound about the first section 31*b* of the outer cylinder part 31 (see FIG. 5). The remainder of the fourth secondary coil Ns4 is run from this wound portion back through the second notch 35Ab, passed through the fourteenth interelectrode groove 42*n*, routed around the side surface of the terminal support base 42N supporting the fourteenth terminal 24N, and electrically connected at the other end to the fourteenth terminal 24N.

The fifth secondary coil Ns5 is electrically connected at one end to the first terminal 24A, routed around the side surface of the terminal support base 42A supporting the first terminal 24A, passed through the first interelectrode groove 42*a*, routed around the first wire post 44A and the fifth wire post 44E, sequentially passed through the first notch 36Aa formed in the outer flange 36, the eleventh outer groove 32Fa of the sixth outer partition 32F from the outer flange 35 in the axial direction of the outer cylinder part 31, the eighth outer groove 32Ea of the fifth outer partition 32E, and the sixth outer groove 32Da of the fourth outer partition 32D, and wound about the fourth section 31*e* of the outer cylinder part 31 (see FIG. 5). The remainder of the fifth secondary coil Ns5 is run from this wound portion, sequentially passed back through the sixth outer groove 32Da, the eighth outer groove 32Ea, the eleventh outer groove 32Fa, and the first notch 36Aa, routed around the fifth wire post 44E and a corner portion on the base part of the terminal support base 42C supporting the third terminal 24C, passed through the second interelectrode groove 42*b*, routed around the side surface of the terminal support base 42B supporting the second terminal 24B, and electrically connected at the other end to the second terminal 24B.

The sixth secondary coil Ns6 is electrically connected at one end to the seventh terminal 24G, routed around the side surface of the terminal support base 42G supporting the seventh terminal 24G, passed through the seventh interelectrode groove 42*g*, routed around a corner portion on a base part of the terminal support base 42F supporting the sixth terminal 24F, routed around the seventh wire post 44G, sequentially passed through the fourth notch 36Ad formed in the outer flange 36, the thirteenth outer groove 32Fc of the sixth outer partition 32F from the outer flange 35 in the axial direction of the outer cylinder part 31, and wound, about the sixth section 31*g* of the outer cylinder part 31 (see FIG. 5). The remainder of the sixth secondary coil Ns6 is run from this wound portion, sequentially passed back through the sixth outer groove 32Da and fourth notch 36Ad, routed around the seventh wire post 44G and fourth wire post 44D, passed through the eighth interelectrode groove 42*h*, routed around the side surface of the terminal support base 42H supporting the eighth terminal 24H, and electrically connected at the other end to the eighth terminal 24H.

The seventh secondary coil Ns7 is electrically connected at one end to the third terminal 24C, routed around the side surface of the terminal support base 42C supporting the third terminal 24C, passed through the third interelectrode groove 42*c*, routed around the second wire post 44B, sequentially passed through the second notch 36Ab formed in the outer flange 36, the twelfth outer groove 32Fb of the sixth outer partition 32F from the outer flange 35 in the axial direction of the outer cylinder part 31, and the ninth outer groove 32Eb of the fifth outer partition 32E, and wound about the fifth section 31*f* of the outer cylinder part 31 (see FIG. 5). The remainder of the seventh secondary coil Ns7 is run from this wound portion, passed sequentially back through the ninth outer groove 32Eb, twelfth outer groove 32Fb, and second notch 36Ab, passed through the fourth interelectrode groove 42*d*, routed around the side surface of the terminal support base 42D supporting the fourth terminal 24D, and electrically connected at the other end to the fourth terminal 24D.

The eighth secondary coil Ns8 is electrically connected at one end to the fifth terminal 24E, routed around the side surface of the terminal support base 42E supporting the fifth terminal 24E, passed through the fifth interelectrode groove 42*e*, sequentially passed through the third notch 36Ac formed in the outer flange 36, and wound about the seventh section 31*h* of the outer cylinder part 31 (see FIG. 5). The remainder of the eighth secondary coil Ns8 is run from this wound portion, passed back through the third notch 36Ac of the outer flange 36, routed around the third wire post 44C, passed through the sixth interelectrode groove 42*f*, routed around the side surface of the terminal support base 42F supporting the sixth terminal 24F, and electrically connected at the other end to the sixth terminal 24F. As described above, each of the secondary coils has a separate and independent output from one another.

Since the bobbin 20 described above includes the inner cylinder part 21 and the outer cylinder part 31, both the wires 50 wound about the inner cylinder part 21 and the wires 50 wound about the outer cylinder part 31 can be reliably insulated. Further, the bobbin 20 is configured of a double-layer construction, enhancing the magnetic coupling effect.

The transformer 1 having the construction described above is manufactured according to the following process. First, a bobbin support part of a winding machine (not shown) is inserted into the space 21*a* defined by the inner peripheral surface of the inner cylinder part 21 (see FIG. 3(*b*)) to hold the inner cylinder part 21. The inner cylinder part 21 is retained on the bobbin support part of the winding machine while the winding machine routes all of the wires 50 and is not removed during this process.

Next, one end of the second primary coil Np2 is temporarily fixed to the fifteenth terminal 24O, while the other end is temporarily fixed to the sixteenth terminal 24P. In order to temporarily fix the wires 50 electrically connected to the fifteenth through twentieth terminals 24O-24T, the ends of these corresponding terminals that extend in the axial direction of the inner cylinder part 21 are bent at a right angle toward the mounting surface side (upward in FIG. 11) in advance.

The method of temporarily fixing both ends of the second primary coil Np2 to the fifteenth terminal 24O and sixteenth terminal 24P is performed as follows. The ends of other wires 50 connected to the seventeenth through twentieth terminals 24Q-24T are temporarily fixed according to a similar method.

First, one end of the second primary coil Np2 is routed to the fifteenth terminal 24O with its distal end bent at a right angle. This end of the second primary coil Np2 is temporarily anchored to the distal end of the fifteenth terminal 24O. Next, the second primary coil Np2 is wound about the first section 21*b* of the inner cylinder part 21.

Similarly, the other end of the second primary coil Np2 wound about the first section 21*b* is routed to the sixteenth terminal 24P. This other end of the second primary coil Np2 is temporarily anchored to the distal end of the sixteenth terminal 24P. This completes the process for temporarily fixing the ends of the second primary coil Np2.

Next, the drive winding Ns1 is temporarily fixed at one end to the eighteenth terminal 24R, wound about the second section 21*c* of the inner cylinder part 21, and temporarily fixed at the other end to the twentieth terminal 24T. The first primary coil Np1 is temporarily fixed at one end to the fifteenth terminal 24O, wound about the third section 21*d* of the inner cylinder part 21, and temporarily fixed at the other end to the seventeenth terminal 24Q. The drive winding Ns1' is temporarily fixed at one end to the nineteenth terminal 24S, wound about the fourth section 21*e* of the inner cylinder part 21, and temporarily fixed at the other end to the twentieth terminal 24T. The third primary coil Np3 is, temporarily fixed at one end to the fifteenth terminal 24O, wound about the fifth section 21*f* of the inner cylinder part 21, and temporarily fixed at the other end to the sixteenth terminal 24P.

Figure 12:
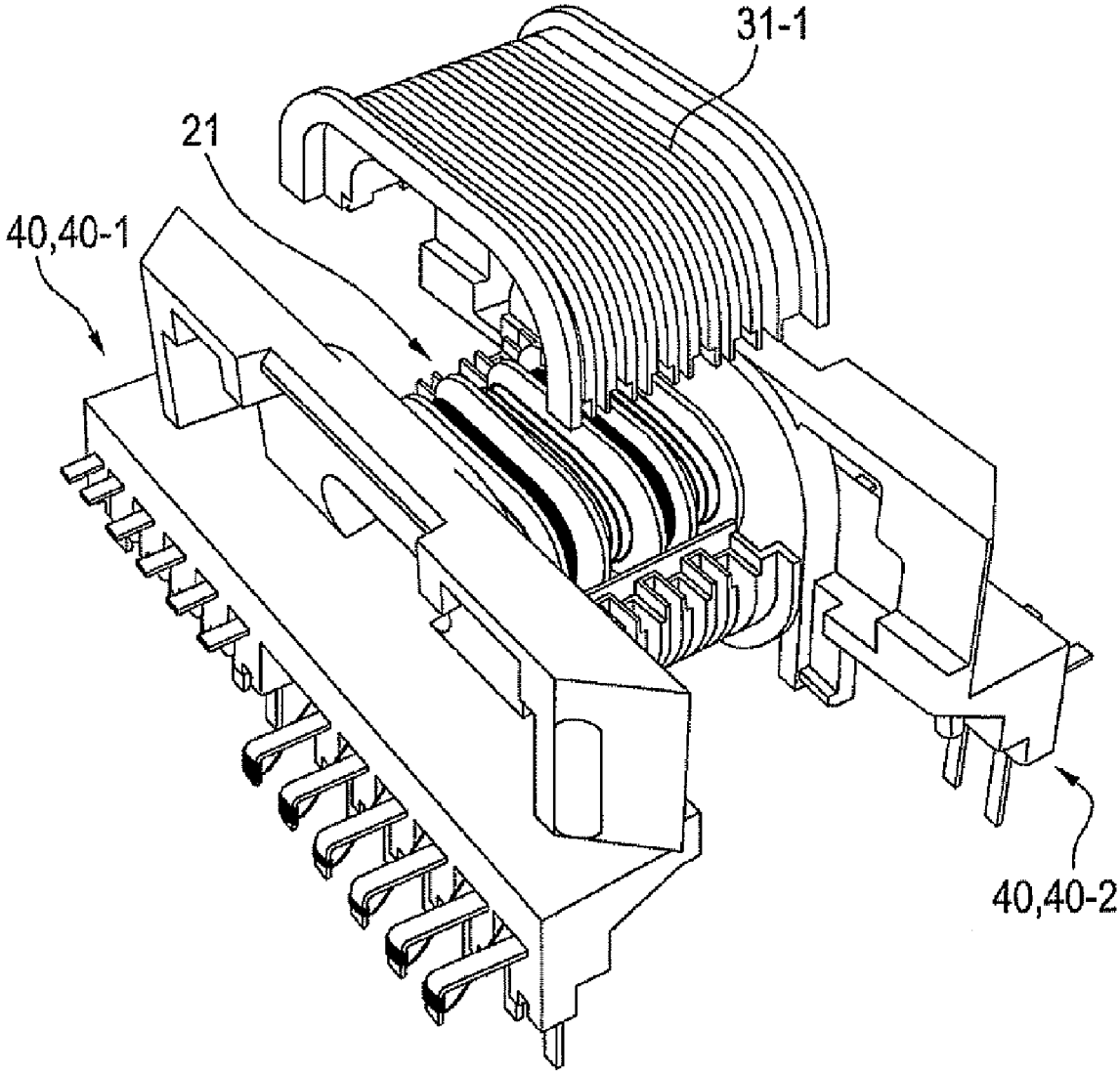
FIG. 12 is a top perspective view of the transformer being about to mount the outer cylinder part over the inner cylinder part wounded with the wire during the manufacturing process according to the first embodiment.
Figure 13:
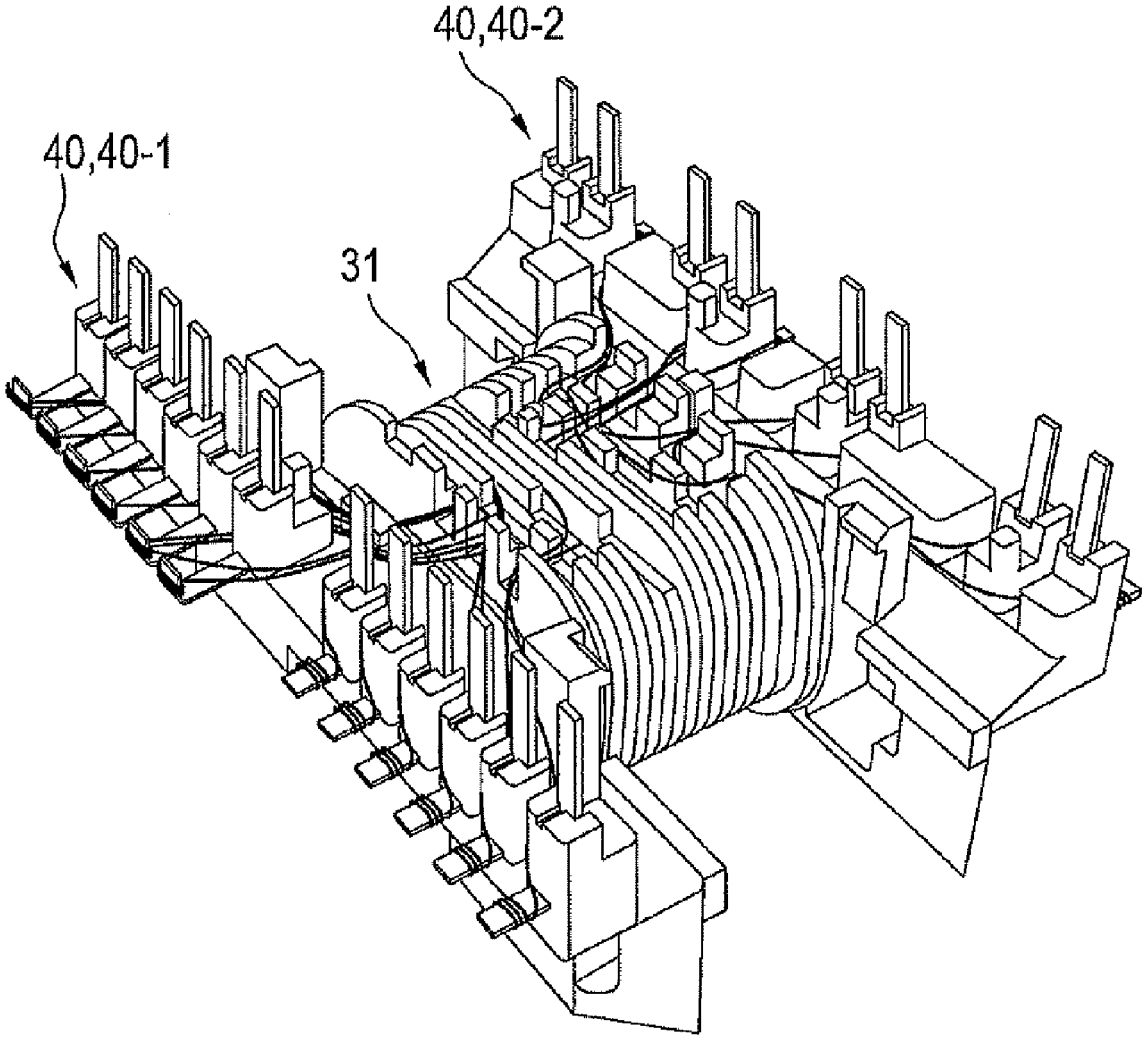
FIG. 13 is a bottom perspective view of the transformer with winding the wire over the outer cylinder part during the manufacturing process according to the first embodiment.
Figure 14:
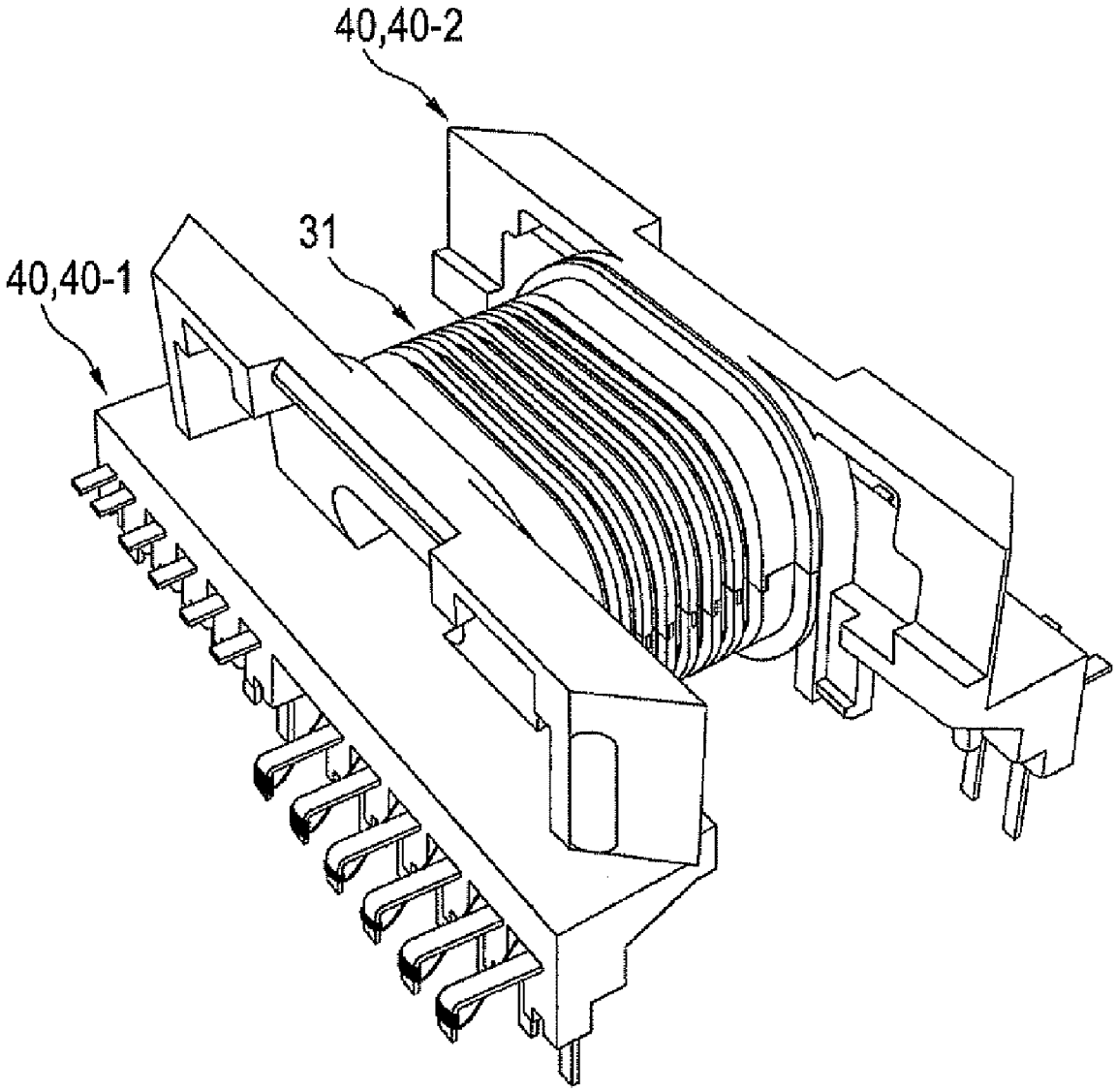
FIG. 14 is a top perspective view of the transformer with winding the wire over the outer cylinder part during the manufacturing process according to the first embodiment.

Next, as illustrated in FIG. 12, the outer cylinder part 31 is mounted around the inner cylinder part 21 by assembling the outer mounting-board-side cylindrical division part 31-2 and outer non-mounting-board-side cylindrical division part 31-1 together. The wires 50 are then wound around each section of the outer cylinder part 31, as illustrated in FIGS. 13 and 14. Specifically, first the fourth secondary coil Ns4 is temporarily fixed at one end to the thirteenth terminal 24M, wound about the first section 31*b* of the outer cylinder part 31, and temporarily fixed at the other end to the fourteenth terminal 24N.

While the second primary coil Np2, drive winding Ns1, first primary coil Np1, drive winding Ns1', and third primary coil Np3 described earlier are temporarily fixed to portions of the terminals extending in the axial direction of the inner cylinder part 21 after the portions have been first bent at a right angle toward the mounting-surface side, the fourth secondary coil Ns4, third secondary coil Ns3, second secondary coil Ns2, eighth secondary coil Ns8, sixth secondary coil Ns6, seventh secondary coil Ns7, and fifth secondary coil Ns5 are temporarily fixed to terminals not having such portions bent at right angles. The remainder of the process of temporarily fixing these coils is identical to that described above.

Specifically, the third secondary coil Ns3 is temporarily fixed at one end to the eleventh terminal 24K, wound about the second section 31*c* of the outer cylinder part 31, and temporarily fixed at the other end to the twelfth terminal 24L. The second secondary coil Ns2 is temporarily fixed at one end to the ninth terminal 24I, wound about the third section 31*d* of the outer cylinder part 31, and temporarily fixed at the other end to the tenth terminal 24J.

Next, the eighth secondary coil Ns8 is temporarily fixed at one end to the fifth terminal 24E, wound about the seventh section 31*h* of the outer cylinder part 31, and temporarily fixed at the other end to the sixth terminal 24F. The sixth secondary coil Ns6 is temporarily fixed at one end to the seventh terminal 24G, wound about the sixth section 31*g* of the outer cylinder part 31, and temporarily fixed at the other end to the eighth terminal 24H. The seventh secondary coil Ns7 is temporarily fixed at one end to the third terminal 24C, wound about the fifth section 31*f* of the outer cylinder part 31, and temporarily fixed at the other end to the fourth terminal 24D. The fifth secondary coil Ns5 is temporarily fixed at one end to the first terminal 24A, wound about the fourth section 31*e* of the outer cylinder part 31, and temporarily fixed at the other end to the second terminal 24B.

Figure 15:
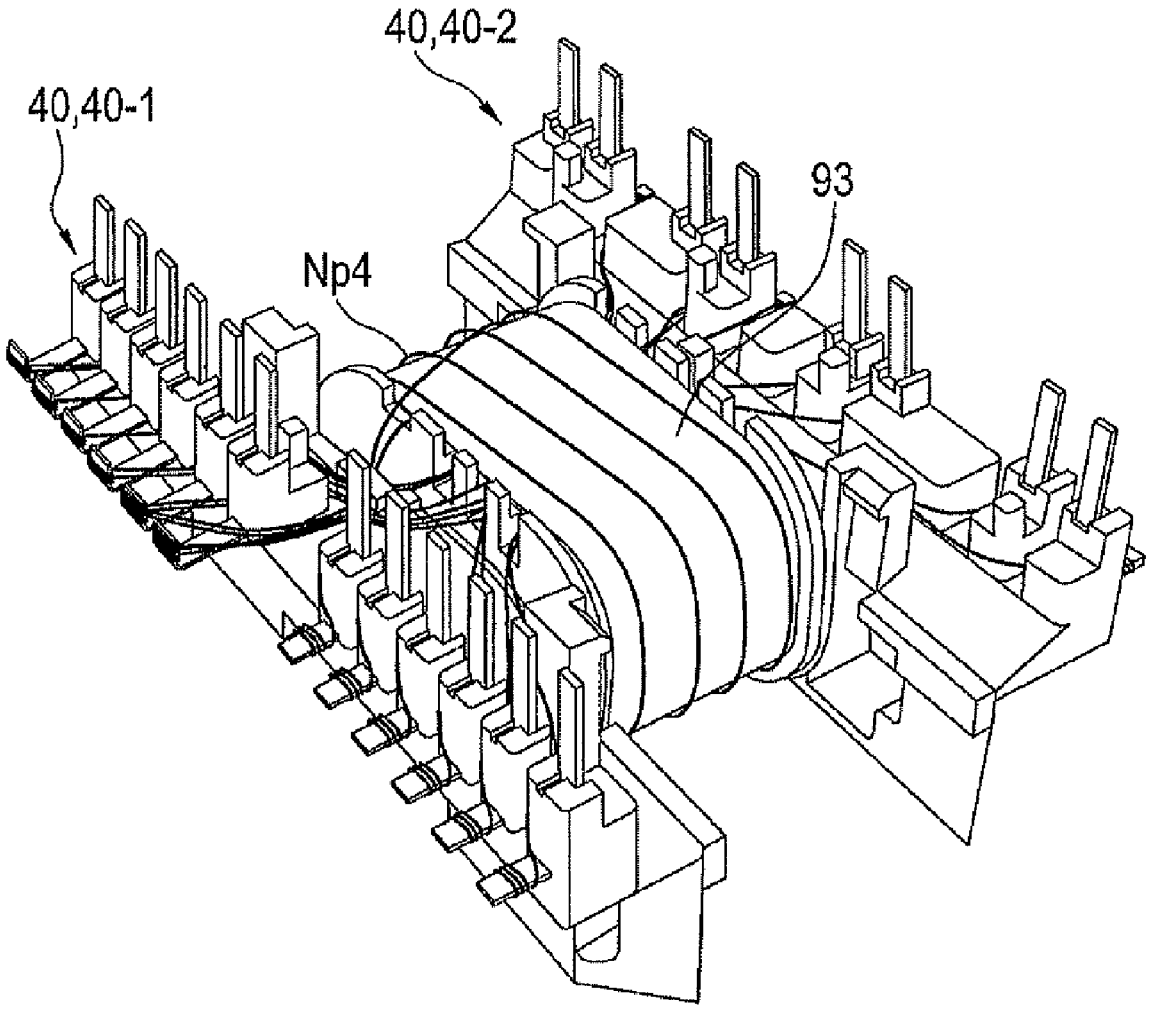
FIG. 15 is a bottom perspective view of the transformer with winding the wire over the outer cylinder part after winding the insulating tape thereover during the manufacturing process according to the first embodiment.

With the wires 50 wound about the outer cylinder part 31, the insulating tape 93 is then wound around the periphery of the outer cylinder part 31. As shown in FIG. 15, the fourth secondary coil Ns4 is temporarily fixed at one end to the fifteenth terminal 24O, wound over the top of the insulating tape 93, and temporarily fixed at the other end to the seventeenth terminal 24Q. Subsequently, the insulating tape 94 is wound over the top of this structure.

Figure 16:
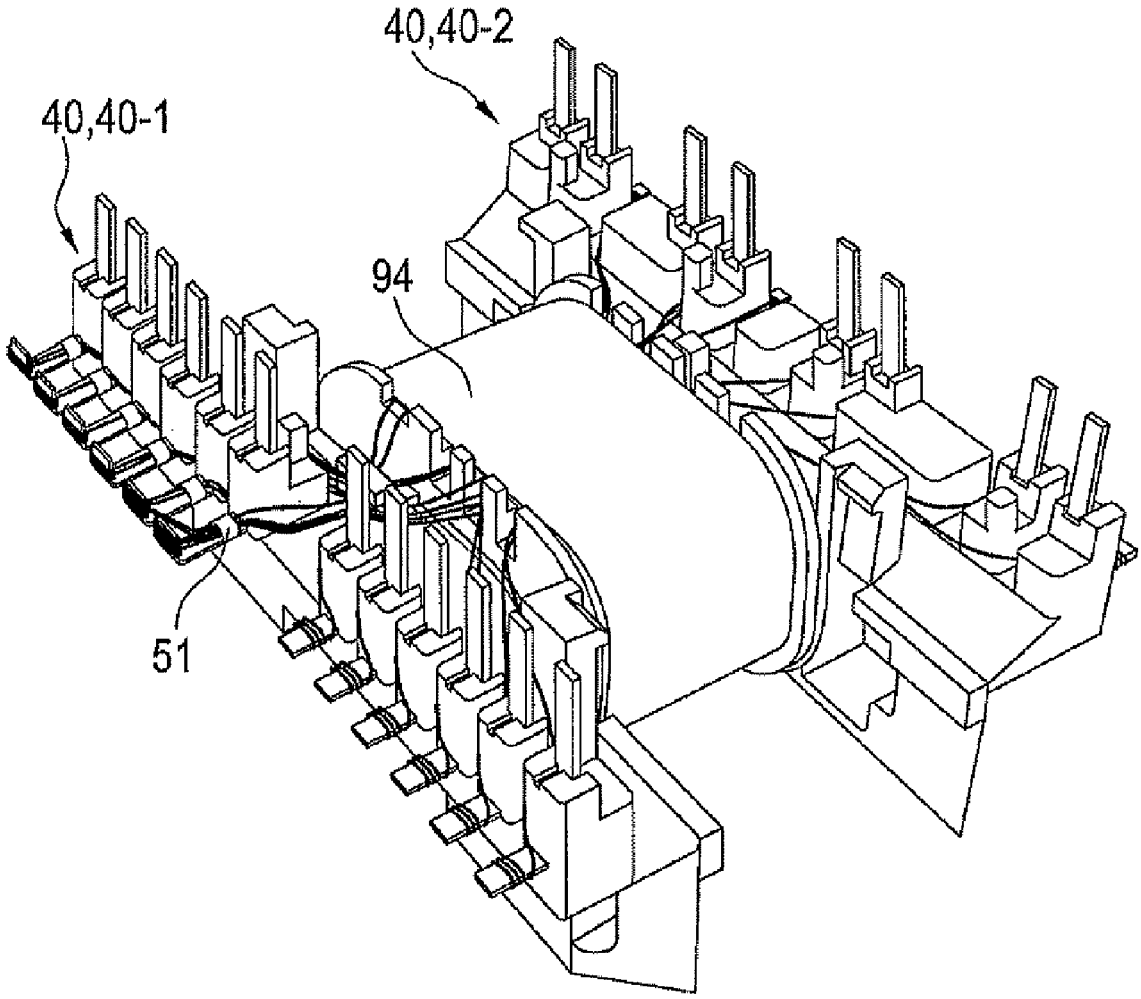
FIG. 16 is a bottom perspective view of the transformer in which the wire and a top edge of a metallic terminal are wound by a fine wire during the manufacturing process according to the first embodiment.

Next, as illustrated in FIG. 16, a separate fine wire 51 is wound around the fifteenth terminal 24O near the base side relative to the bent end. The fine wire 51 is wound a plurality of turns orthogonal to the longitudinal direction of the fifteenth terminal 24O in order to bind the end of the second primary coil Np2 to the bent end of the fifteenth terminal 24O. This process forms a fine wire winding part for fixing the end of the second primary coil Np2 to the bent end of the fifteenth terminal 24O. Next, the fifteenth terminal 24O and the end of the second primary coil Np2 on the outside of the fine wire winding part toward the distal end of the fifteenth terminal 24O is cut along a plane orthogonal to the axial direction of the fifteenth terminal 24O, thereby finishing the fifteenth terminal 24O and aligning the end of the second primary coil Np2 with the endface of the fifteenth terminal 24O. By cutting the fifteenth terminal 24O in this way, the endface of the fifteenth terminal 24O is flush with the endface of the second primary coil Np2. The same process is performed for the remaining sixteenth through twentieth terminals 24P-24T.

Figure 17:
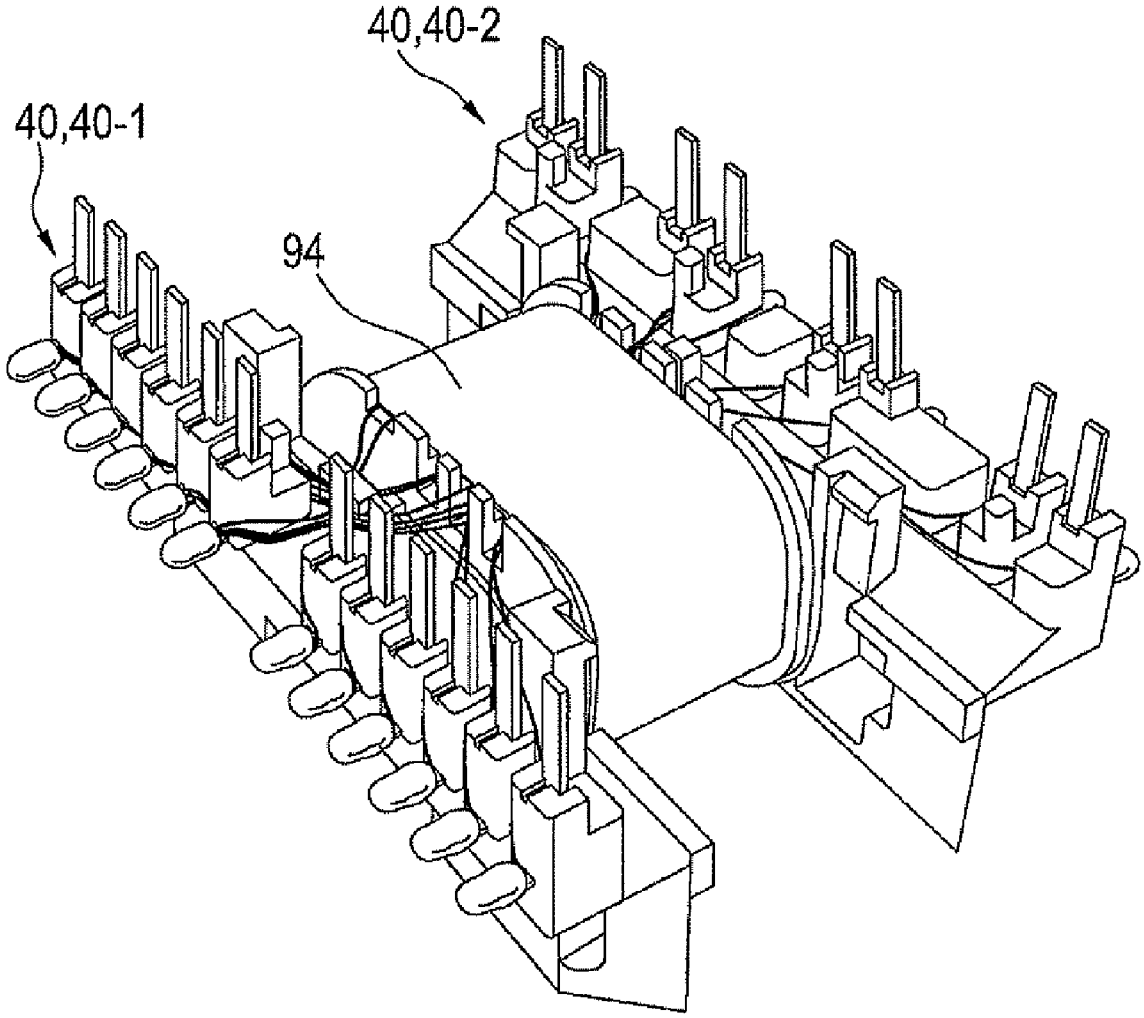
FIG. 17 is a bottom perspective view of the transformer after the metallic terminal is soldered by immersing the same in a solder bath during the manufacturing process according to the first embodiment.

Next, the first terminal 24A, second terminal 24B, . . . , and twentieth terminal 24T are soldered by immersing the same in a solder bath. This soldering operation forms a solder fillet that covers the fine wire winding part and envelops the terminal electrode 24 and the end of the wires 50, as shown in FIG. 17. Thus, the solder fillet envelops the endfaces of the wires 50 and the endface of the respective terminal electrode 24 for each of the terminals 24O-24T, forming an electrical connection between the terminal electrode 24 and wires 50.

Figure 18:
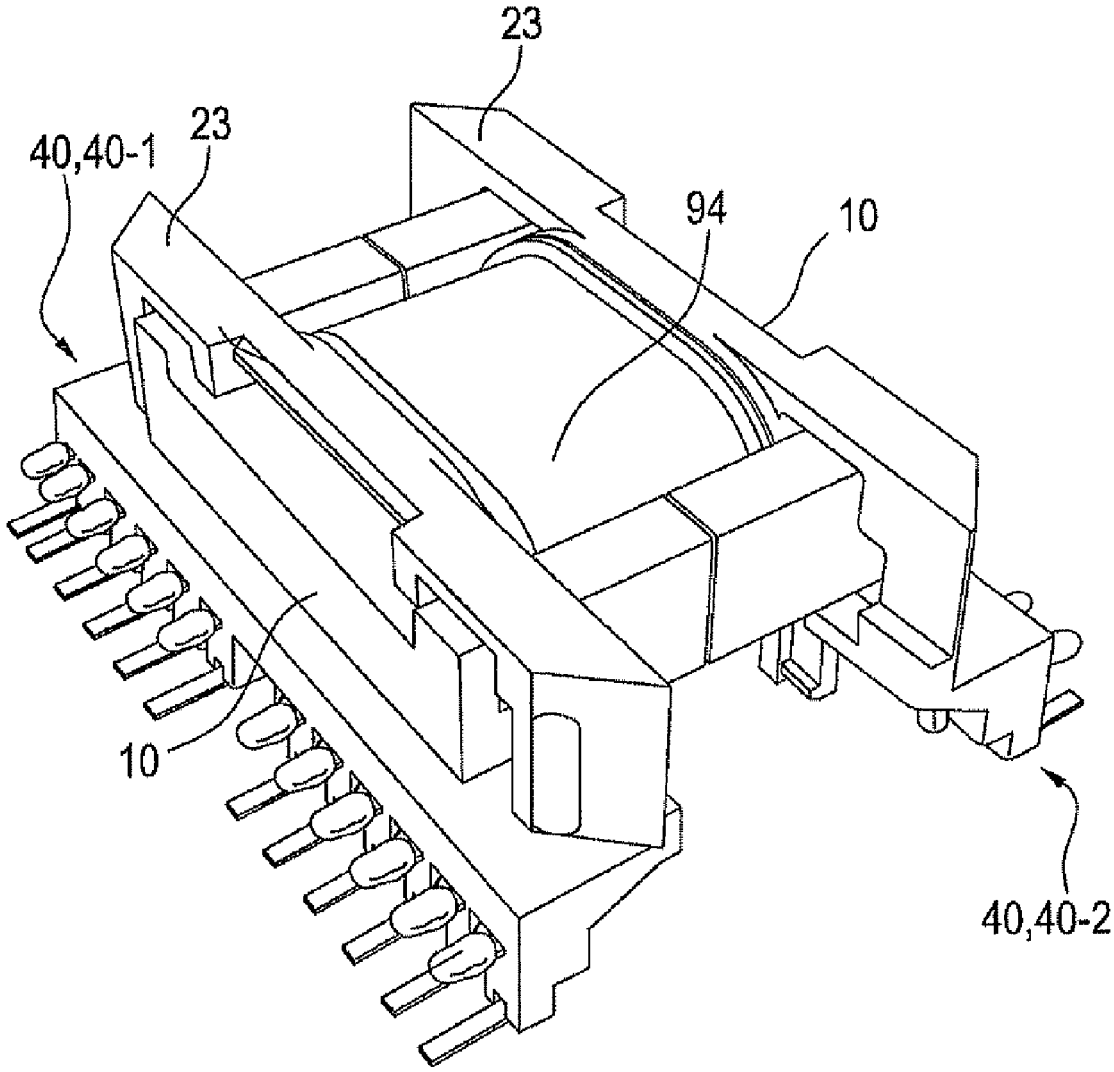
FIG. 18 is a top perspective view of the transformer in which a bobbin is mounted to a core during the manufacturing process according to the first embodiment.
Figure 19:
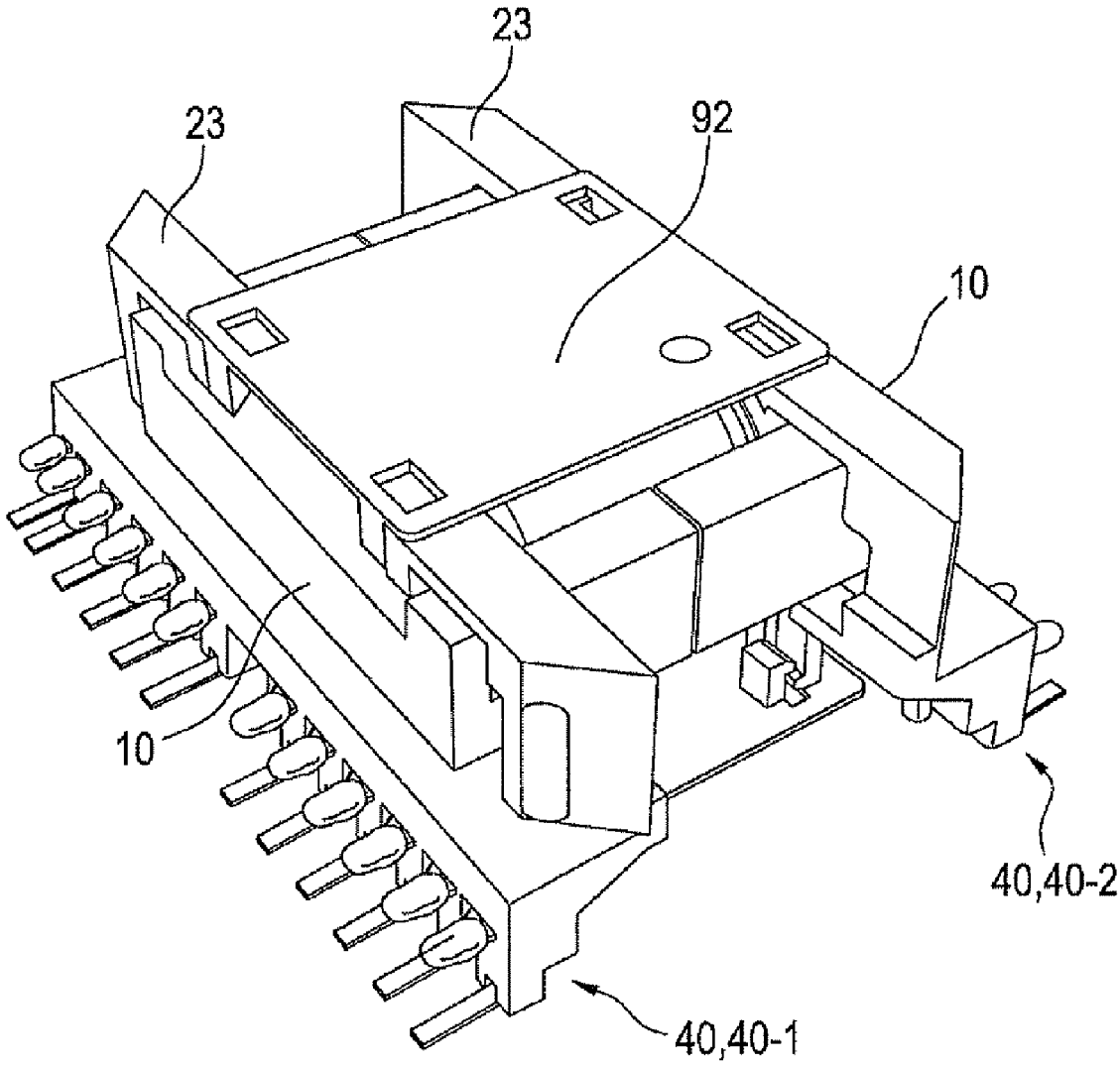
FIG. 19 is a top perspective view of the transformer mounted a casing during the manufacturing process according to the first embodiment.
Figure 20:
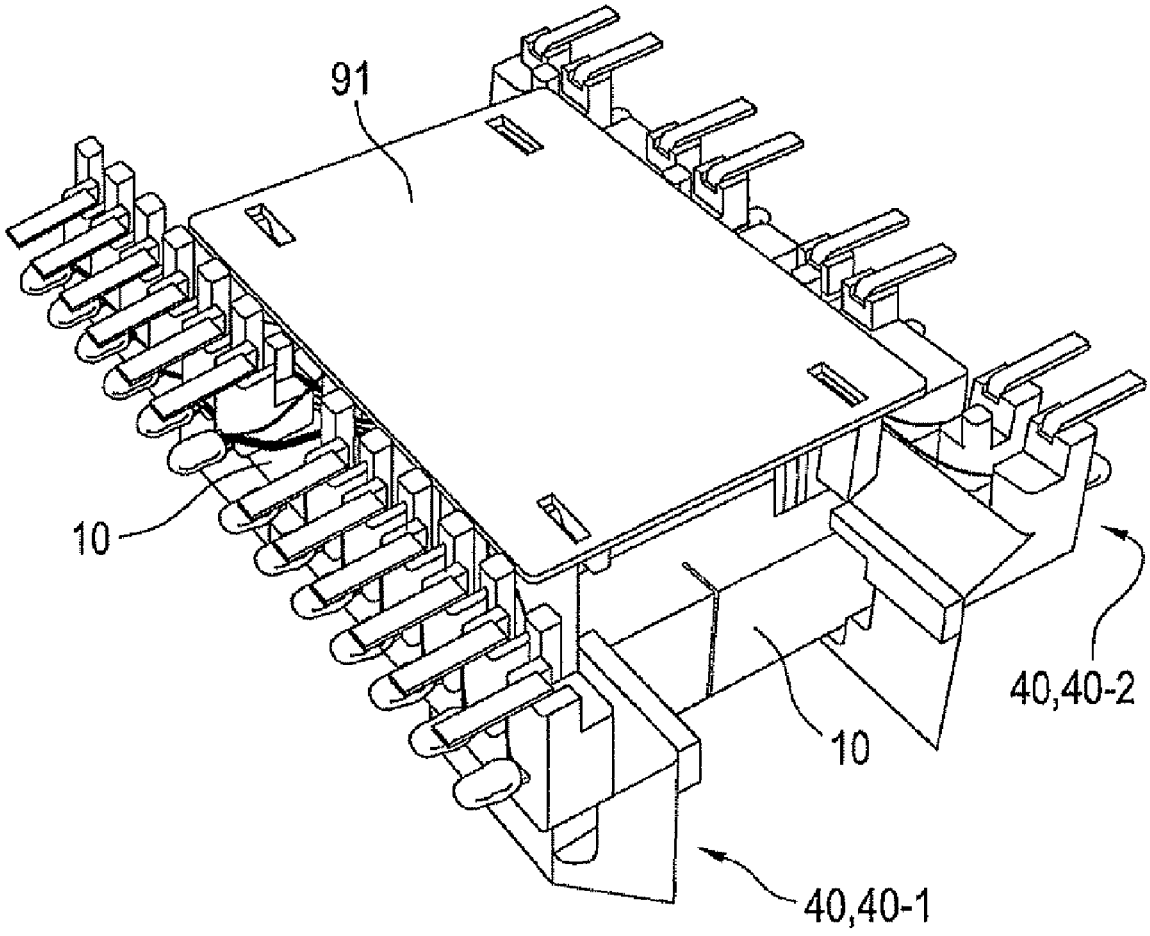
FIG. 20 is a bottom perspective view of the transformer mounted the casing during the manufacturing process according to the first embodiment.

Next, the substantially L-shaped terminal electrodes 24 are formed substantially into a U-shape by bending the edge of the terminal electrode 24 where the solder fillet is not formed, and the cores 10 are mounted onto the assembly, as shown in FIG. 18. Production of the transformer 1 is completed by mounting the mounting-surface-side casing 91 and the non-mounting-surface side casing 92, as illustrated in FIGS. 19 and 20.

With this configuration, disposing the hook part 45 around which the primary coils Np1-Np3 are hooked between the inner cylinder part 21 and the terminal electrode 24 reduces the distance between the inner cylinder part 21 and the hook part 45, thereby preventing outward projection of the wires 50. Further, since the hook part 45 is disposed such that the primary coils Np1-Np3 passes through all outer grooves present between their respective sections and the hook part 45, the hook part 45 restricts movement of the primary coils Np1-Np3 in the radial direction of the inner cylinder part 21, thereby preventing the primary coils Np1-Np3 from coming out of the outer grooves. Thus, after one primary coil is wound about the inner cylinder part 21 and anchored to the terminal electrode 24, another primary coil can be wound about the inner cylinder part 21 and run over the terminal base 40 without interference from the one primary coil, thereby improving work efficiency in the machine-automated operation. Further, since the hook part 45 restricts radial movement of the primary coils Np1-Np3, the secondary coils Ns2-Ns8 can be wound over the primary coils Np1-Np3 without interfering with the same, thereby improving work efficiency in the machine-automated operation.

Since the hook part 45 and outer grooves 22Aa-22Ea are positioned along a substantially straight line and the range over which the primary coils Np1-Np3 must be guided when running a wire with machine automation can be minimized, this configuration prevents interference between two primary coils.

Since the hook part 45 restricts outward projection of the primary coils Np1-Np3, the outer cylinder part 31 can be mounted without contacting the primary coils Np1-Np3. Further, the secondary coils Ns2-Ns8 may be wound over the outer cylinder part 31, in which case both the primary coils Np1-Np3 wound about the inner cylinder part 21 and the secondary coils Ns2-Ns8 wound about the outer cylinder part 31 are both reliably insulated by the outer cylinder part 31.

By hooking each primary coil on the hook part 45 disposed between the inner cylinder part 21 and the terminal electrodes 24, it is possible to prevent interference between primary coils Np1-Np3 when the wires 50 are machine-wound. This configuration also prevents the one of primary coil wound in one section of the inner cylinder part 21 from interfering with another primary coil wound subsequently in another section, thereby improving work efficiency for running primary coils with machine-automation.

Next, a transformer 101 according to a second embodiment of the present invention will be described with reference to FIGS. 21 though 24, wherein like parts and components are designated with the same reference numerals to avoid duplicating description.

The transformer 101 according to the second embodiment includes a pair of cores 10 (not shown) similar to the transformer 1 according to the first embodiment, a bobbin 120, wires 150, and casings 91 and 92 (not shown) similar to the transformer 1 according to the first embodiment.

Figure 21:
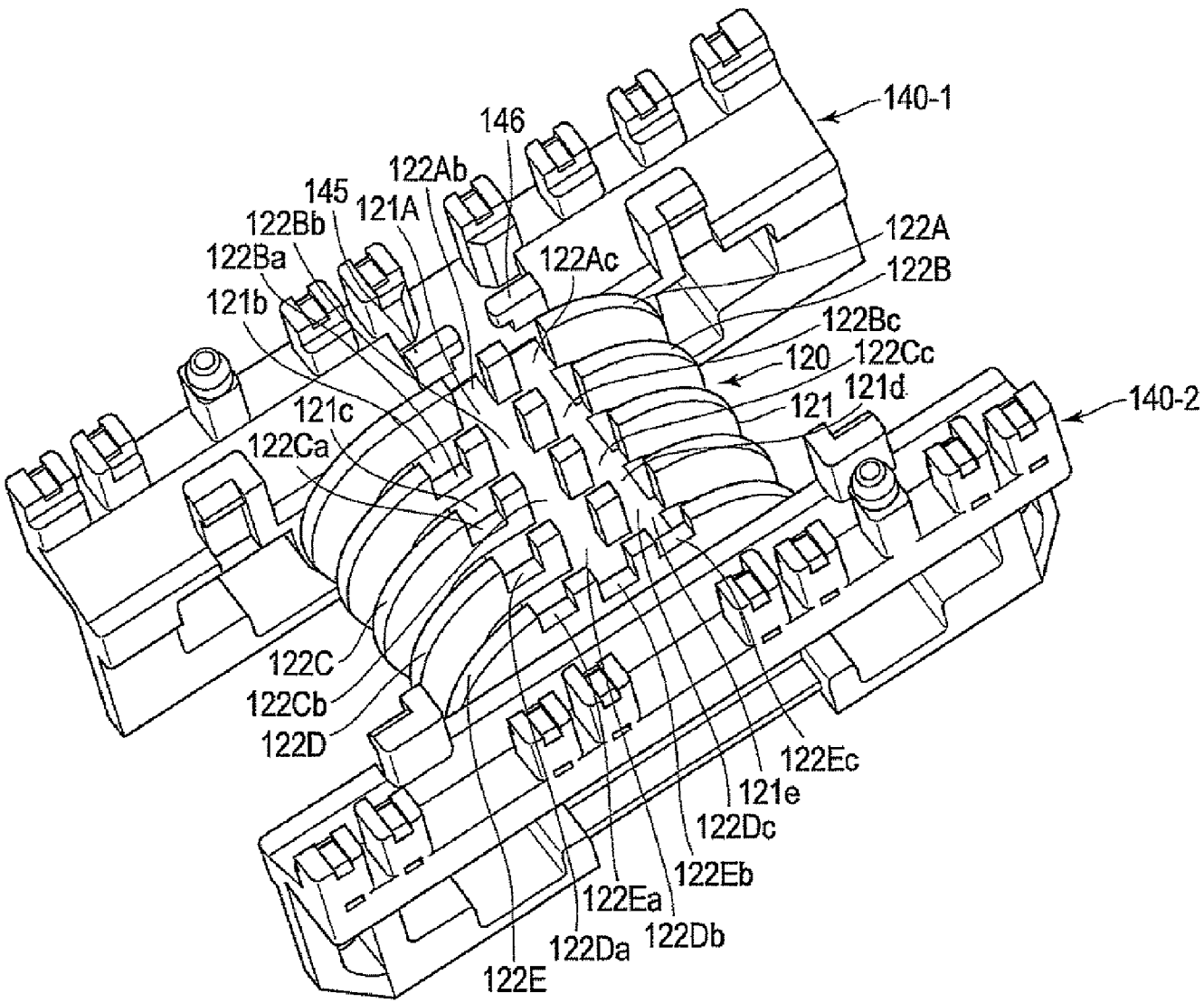
FIG. 21 is a bottom perspective view of a cylinder part and a terminal base of a transformer according to a second embodiment of the present invention.

The bobbin 120 shown in FIG. 21 includes a cylinder part 121, and terminal bases 140 provided one on each axial end of the cylinder part 121. The cylinder part 121 is cylindrical with an elliptical cross section similar to the inner cylinder part 21 described in the first embodiment. One of the parallel linear parts in the cross section of the cylinder part 121 is parallel to the top surface of a mounting board (not shown) and serves as a mounting-board-opposing surface 121A (see FIG. 21), while the other parallel linear part serves as a non-mounting-board-opposing surface 121B.

Partitions 122A-122B are disposed on the peripheral surface of the cylinder part 121. As shown in FIG. 21, five plate-shaped partitions 122A-122E are erected on the peripheral surface of the cylinder part 121 and encircle the entire surface in the circumferential direction. The partitions 122A-122E partition the peripheral surface of the cylinder part 121 into four sections. These sections will be referred to, in order from top to bottom in FIG. 21, as a first section 121*b*, a second section 121*c*, a third section 121*d*, and a fourth section 121*e*. The wires 150 described later are wound uniformly about each of these sections. Each section of the cylinder part 121 is equivalent to a wire winding section.

Grooves 122Ba-122Ea having a prescribed depth are respectively formed in portions of the partitions 122B-122E, i.e., the second through fifth partitions in order from one axial end of the cylinder part 121. The grooves 122Ba-122Ea are formed in a straight line following the axial direction of the cylinder part 121 on the side of the partitions positioned above the mounting-board-opposing surface 121A and recess inward along a radial direction of the cylinder part 121. Each of the grooves 122Ba-122Ea has a prescribed width in the circumferential direction of the cylinder part 121 and is positioned offset from a center of the cylinder part 121 at a prescribed distance in the circumferential direction of the cylinder part 121. The grooves 122Ba-122Da are formed deeper in the radial direction of the cylinder part 121 than the groove 122Ea. Notches 122Ab-122Db having a depth equivalent to the height of the partitions 122A-122D are formed in portions of the partitions 122A-122D, i.e., the first through fourth partitions arranged from one axial end of the cylinder part 121, and are positioned along a straight line in the axial direction of the cylinder part 121. The notches 122Ab-122Db are formed from a central position of the respective partitions 122A-122D in the circumferential direction of the cylinder part 121 to a prescribed position in the circumferential direction. A groove 122Eb is formed in the partition 122E on an extension to the straight line formed by the notches 122Ab-122Db. The groove 122Eb is formed shallower in the radial direction of the cylinder part 121 than the groove 122Ea. Notches 122Ac-122Dc are formed in portions of the partitions 122A-122D, i.e., the first through fourth partitions in order from one axial end of the cylinder part 121, in a region positioned a prescribed distance from the position at which the notches 122Ab-122Db are formed with respect to the circumferential direction. The notches 122Ac-122Dc are formed in a straight line following the axial direction of the cylinder part 121 at a depth equivalent to the height of the partitions 122A-122D. A groove 122Ec having a prescribed depth is formed inward in a radial direction of the cylinder part 121 on an extension to the line formed by the notches 122Ac-122Dc. The groove 122Ec has a depth in the radial direction of the cylinder part 121 identical to the groove 122Ea.

Each of the terminal bases 140 has a plurality of terminal support parts 142. A total of sixteen terminal electrodes 124 are disposed on the mounting-surface side of the terminal support parts 142. Specifically, the terminal bases 140 include a terminal base 140-1 and a terminal base 140-2 disposed one on each axial end of the cylinder part 121, and eight of the terminal electrodes 124 are disposed on each of the terminal bases 140-1 and 140-2. Each of the terminal electrodes 124 is substantially U-shaped, as described in the first embodiment.

Figure 22:
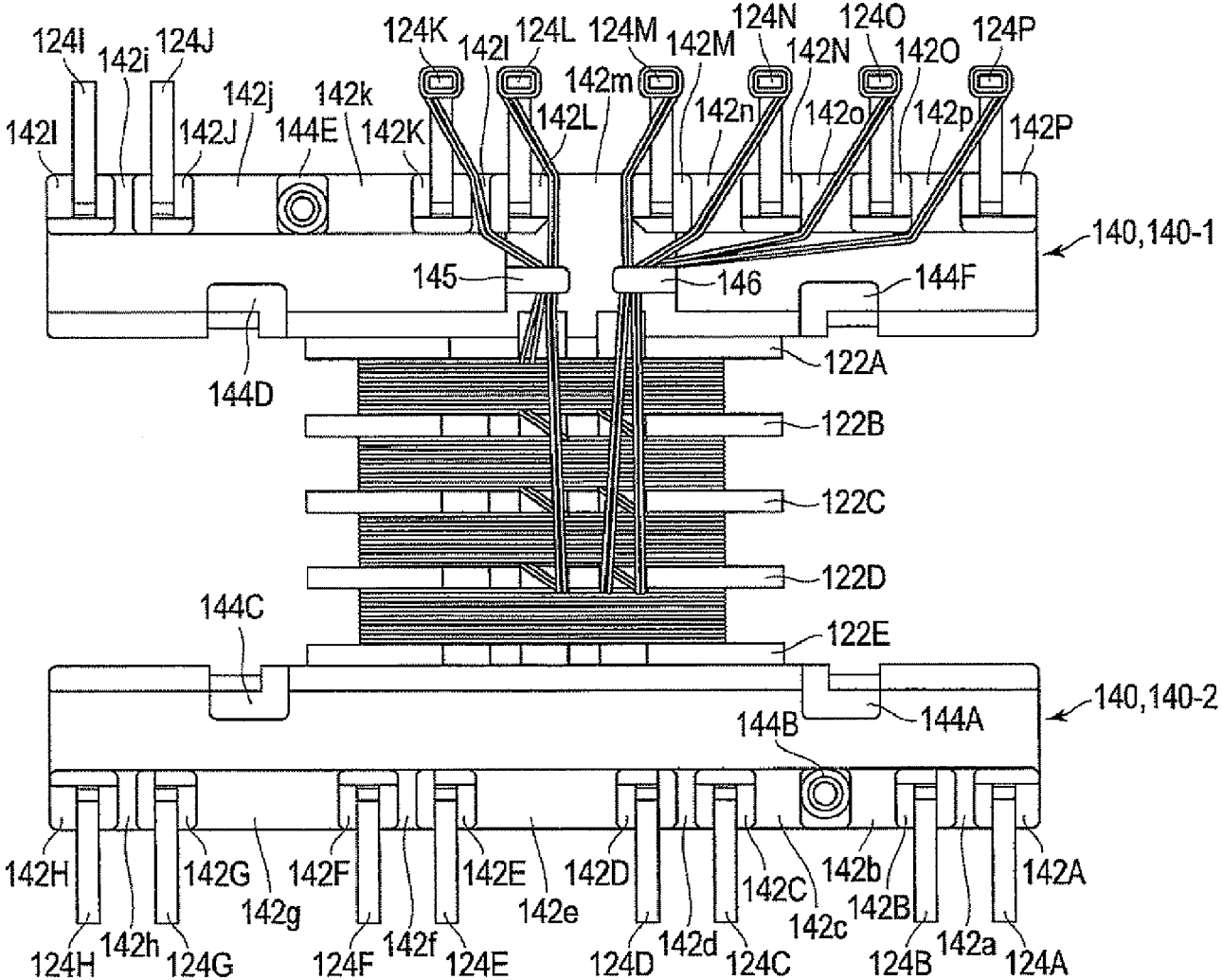
FIG. 22 is a bottom view of the transformer with winding a primary wire over the cylinder part according to the second embodiment.

As shown in FIG. 22, the eight terminal electrodes 124 on the terminal support part 142 provided in the terminal base 140-2 on the other axial end of the cylinder part 121 are a first terminal 124A, a second terminal 124B, . . . , and an eighth terminal 124H. Further, the eight terminal electrodes 124 on the terminal support part 142 provided in the terminal base 140-1 on the first axial end of the cylinder part 121 are a ninth terminal 124I, a tenth terminal 124J, . . . , and a sixteenth terminal 124P. The terminal support parts 142 supporting the first terminal 124A, second terminal 124B, . . . , and sixteenth terminal 124P have corresponding terminal support bases 142A, 142B, . . . , and 142 protruding toward the mounting-surface side.

As shown in FIG. 22, a first interelectrode groove 142*a*, a second interelectrode groove 142*b*, . . . , and an eighth interelectrode groove 142*h* are formed at positions between adjacent terminal support parts 142 on the terminal base 140-2. Similarly, a ninth interelectrode groove 142*i*, a tenth interelectrode groove 142*j*, . . . , and a sixteenth interelectrode groove 142*p* are formed at positions between adjacent terminal support parts 142 on the terminal base 140-1.

As shown in FIG. 22, a first wire post 144A, a second wire post 144B, and a third wire post 144C are provided on the terminal support part 142 of the terminal base 140-2, and a fourth wire post 144D, a fifth wire post 144E, and a sixth wire post 144F are provided on the terminal support part 142 of the terminal base 140-1.

Specifically, the first wire post 144A is disposed near the terminal support base 142B supporting the second terminal 124B. The second wire post 144B is disposed at a position opposing the first wire post 144A between the terminal support base 142B supporting the second terminal 124B and the terminal support base 142C supporting the third terminal 124C. The third wire post 144C is disposed near the terminal support base 142G supporting the seventh terminal 124G. The fourth wire post 144D is disposed near the terminal support base 142J supporting the tenth terminal 124J. The fifth wire post 144E is disposed at position substantially opposing the fourth wire post 144D between the terminal support base 142J supporting the tenth terminal 124J and the terminal support base 142K supporting the eleventh terminal 124K. The sixth wire post 144F is disposed near the terminal support base 142O supporting the fifteenth terminal 124O.

As shown in FIG. 21, one end each of respective hook parts 145 and 146 are supported on the terminal base 140-1, and specifically on the surface expanded from the thirteenth interelectrode groove 142*m*. Each of the hook parts 145 and 146 protrudes outward from this expanded surface in a radial direction of the cylinder part 121. Further, the distal end of each of the hook parts 145 and 146 is bent to form a L-shape. The hook part 145 is positioned substantially along an extension of a straight line connecting the notches 122Ab-122Db and the groove 122Eb so that a portion of the hook part 145 overlaps the opening in the notch 122Ab when the hook part 145 is viewed along the axial direction of the cylinder part 121. Similarly, the hook part 146 is positioned substantially along an extension of a straight line connecting the notches 122Ac-122Dc and the groove 122Ec so that a portion of the hook part 146 overlaps the opening in the notch 122Ac when the hook part 146 is viewed along the axial direction of the cylinder part 121. The hook part 146 is symmetrical to the hook part 145. The distance from the expanded surface of the thirteenth interelectrode groove 142*m* to the bent portions of the hook parts 145 and 146 is set less than the height of the partitions 122A-122E erected from the cylinder part 121.

Figure 23:
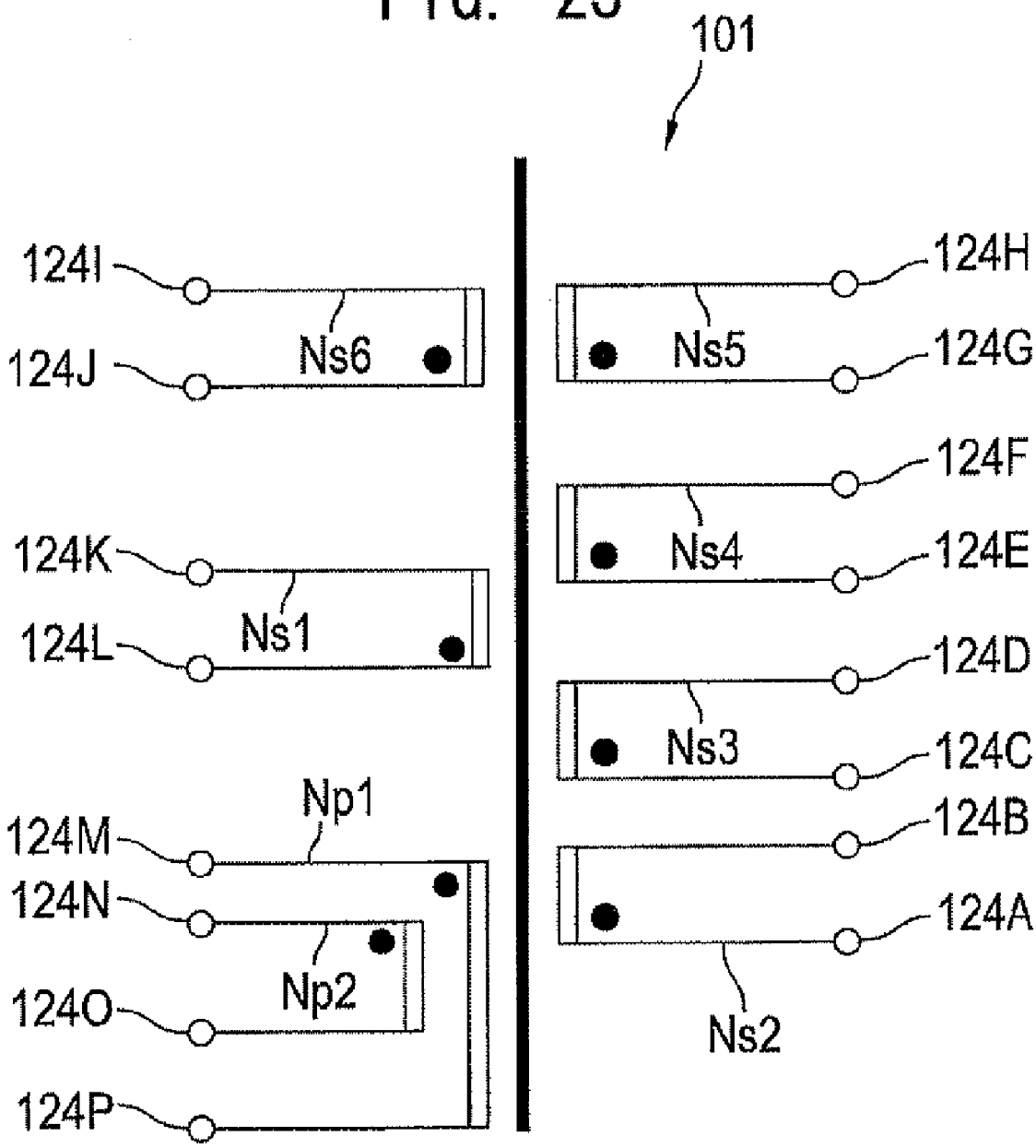
FIG. 23 is a schematic circuit diagram of the transformer according to the second embodiment.

The wires 150 are copper wires with an insulating coating. As shown in FIG. 23, the wires 150 include a first primary coil Np1, a second primary coil Np2, a drive winding Ns1, a second secondary coil Ns2, a third secondary coil Ns3, a fourth secondary coil Ns4, a fifth secondary coil Ns5, and a sixth secondary coil Ns6. Each of the primary coils is configured of a triple-insulated wire with high insulating properties.

In the second embodiment, each coil is wound in the first through fourth sections 121*b*-121*e* so that the windings in all sections are substantially uniform. Further, after the first primary coil Np1 and drive winding Ns1 are wound substantially uniformly in all sections of the cylinder part 121, then the second secondary coil Ns2, third secondary coil Ns3, fourth secondary coil Ns4, fifth secondary coil Ns5, and sixth secondary coil Ns6 are wound directly over these primary coils. Lastly, the second primary coil Np2 is wound around these secondary coils.

Figure 24:
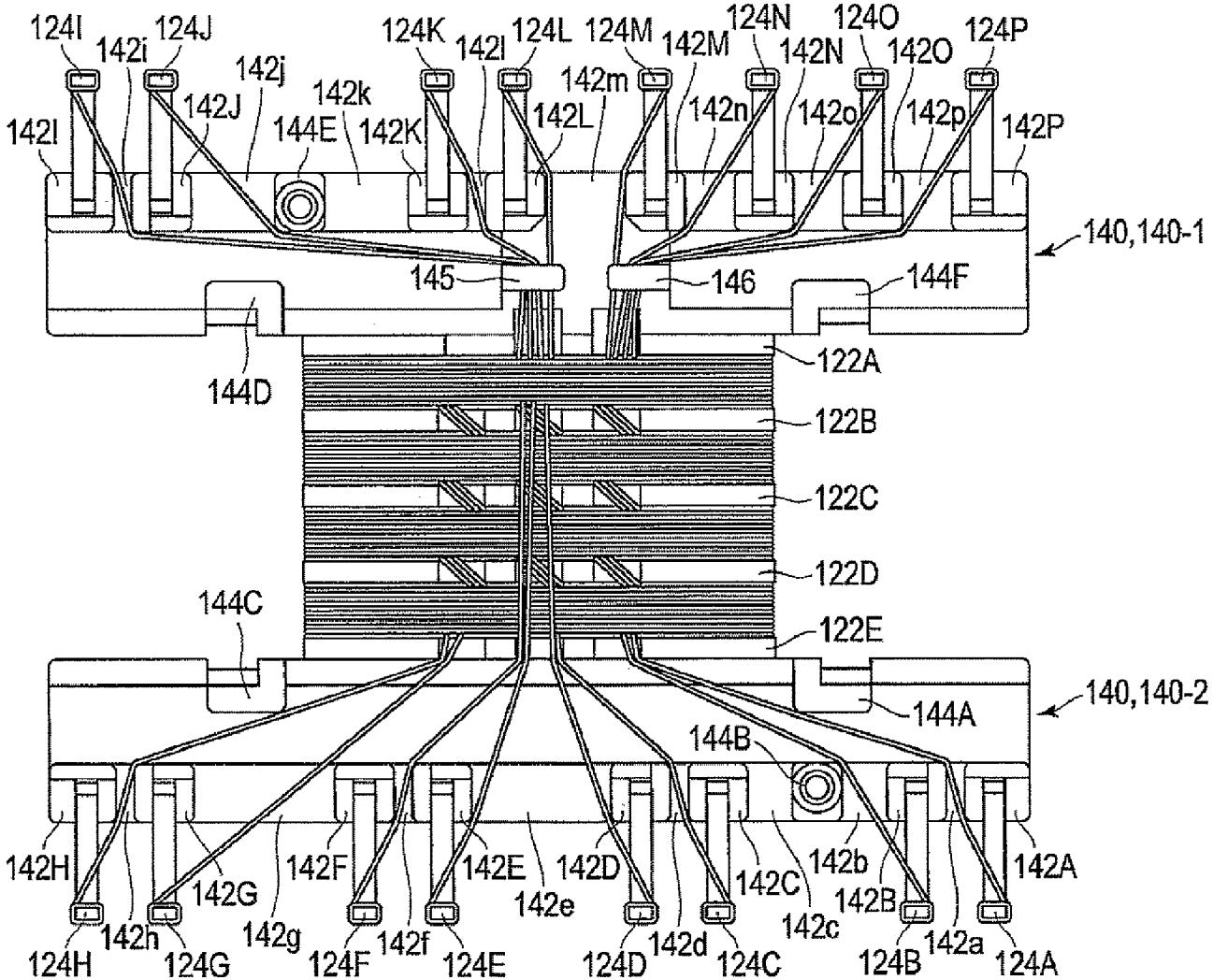
FIG. 24 is a bottom view of the transformer with winding a secondary wire over the cylinder part according to the second embodiment.

More specifically, as shown in FIGS. 22 and 24, the first primary coil Np1 is electrically connected at one end to the thirteenth terminal 124M, passed through the thirteenth interelectrode groove 142*m*, routed around the side surface of the terminal support base 142M supporting the thirteenth terminal 124M, hooked over the hook part 146, passed through the notch 122Ac, and wound uniformly about the first through fourth sections 121*b*-121*e* while being passed sequentially through the notches 122Bc-122Dc. After being wound uniformly in all sections, the first primary coil Np1 is passed sequentially back through all notches formed between the last section in which the first primary coil Np1 was wound and the sixteenth terminal 124P along an extension of the line connecting the hook part 146 and notch 122Ac, hooked over the hook part 146, routed around the side surface of the terminal support base 142O supporting the fifteenth terminal 124O, passed through the sixteenth interelectrode groove 142*p*, and electrically connected at the other end to the sixteenth terminal 124P.

The drive winding Ns1 is electrically connected at one end to the eleventh terminal 124K, routed around the side surface of the terminal support base 142K supporting the eleventh terminal 124K, passed through the twelfth interelectrode groove 142*l*, routed around the side surface of the terminal support base 142L supporting the twelfth terminal 124L, hooked over the hook part 145, passed through the notch 122Ab, and wound uniformly about the first through fourth sections 121*b*-121*e* while being sequentially passed through the notches 1223*b*-122Db. After being uniformly wound in all sections, the drive winding Ns1 is passed sequentially through all notches present between the last section in which the drive winding Ns1 was wound and the twelfth terminal 124L along an extension to the line connecting the hook part 145 and notch 122Ab, hooked over the hook part 145, passed through the thirteenth interelectrode groove 142*m*, routed around the side surface of the terminal support base 142L supporting the twelfth terminal 124L, and electrically connected at the other end to the twelfth terminal 124L.

As described above, all primary coils excluding the second primary coil Np2 wound about the cylinder part 121 are electrically connected to terminals while being hooked on the hook part 145 or the hook part 146 disposed between the terminals and the cylinder part 121, thereby preventing the lead ends of the primary coils from projecting outward between the cylinder part 121 and their respective terminals. Further, since the hook part 145 or hook part 146 restricts each primary coil from rising upward between the cylinder part 121 and the respective terminal, the primary coil wound previously does not interfere with the subsequently routed primary coil, i.e., the second primary coil Np2, thereby improving the efficiency of the machine-automated operation.

As shown in FIGS. 23 and 24, the second secondary coil Ns2 is electrically connected at one end to the first terminal 124A, routed around the side surface of the terminal support base 142A supporting the first terminal 124A, passed through the first interelectrode groove 142*a*, routed around the side surface of the terminal support base 142B supporting the second terminal 124B, routed around the first wire post 144A, passed through the groove 122Ec, and wound uniformly about the first through fourth sections 121*b*-121*e* while being passed sequentially through the notches 122Ac-122Dc. After being uniformly wound in all sections, the remainder of the second secondary coil Ns2 is passed through the groove 122Ec, routed around the side surface of the second wire post 144B, passed through the second interelectrode groove 142*b*, and electrically connected at the other end to the second terminal 124B.

The third secondary coil Ns3 is electrically connected at one end to the third terminal 124C, routed around the side surface of the terminal support base 142C supporting the third terminal 124C, passed through the fourth interelectrode groove 142*d*, routed around the side surface of the terminal support base 142D supporting the fourth terminal 124D, passed through the groove 122Eb, and wound uniformly about the first through fourth sections 121*b*-121*e* while being sequentially passed through the notches 122Ab-122Db. After being wound uniformly in all sections, the remainder of the third secondary coil Ns3 is passed back through the groove 122Eb, passed through the fifth interelectrode groove 142*e*, routed around the side surface of the terminal support base 142D supporting the fourth terminal 124D, and electrically connected at the other end to the fourth terminal 124D.

The fourth secondary coil Ns4 is electrically connected at one end to the fifth terminal 124E, routed around the side surface of the terminal support base 142E supporting the fifth terminal 124E, passed through the fifth interelectrode groove 142*e*, passed through the groove 122Eb, and wound uniformly about the first through fourth sections 121*b*-121*e* while being sequentially passed through the notches 122Ab-122Db. After being wound uniformly in all sections, the remainder of the fourth secondary coil Ns4 is passed back through the groove 122Eb, routed over the side surface of the terminal support base 142E supporting the fifth terminal 124E, passed through the sixth interelectrode groove 142*f*, routed around the side surface of the terminal support base 142E supporting the sixth terminal 124F, and electrically connected at the other end to the sixth terminal 124F.

The fifth secondary coil Ns5 is electrically connected at one end to the seventh terminal 124G, passed through the seventh interelectrode groove 142*g*, passed through the groove 122Ea, and wound uniformly around the first through fourth sections 121*b*-121*e* while being sequentially passed through the grooves 122Ba-122Da. After being wound uniformly about all sections, the remainder of the fifth secondary coil Ns5 is passed back through the groove 122Ea, routed around the third wire post 144C and the side surface of the terminal support base 142G supporting the seventh terminal 124G, passed through the eighth interelectrode groove 142*h*, routed around the side surface of the terminal support base 142H supporting the eighth terminal 124H, and electrically connected at the other end to the eighth terminal 124H.

The sixth secondary coil Ns6 is electrically connected at one end to the ninth terminal 124I, routed around the side surface of the terminal support base 142I supporting the ninth terminal 124I, passed through the ninth interelectrode groove 142*i*, routed around the side surface of the terminal support base 142J supporting the tenth terminal 124J, hooked over the hook part 145, and wound uniformly about the first through fourth sections 121*b*-121*e* while being sequentially passed through the notches 122Ab-122Db. After being wound uniformly around all sections, the remainder of the sixth secondary coil Ns6 is hooked over the hook part 145, routed around the fifth wire post 144T, passed through the tenth interelectrode groove 142*j*, and electrically connected at the other end to the tenth terminal 124J.

The second primary coil Np2 is electrically connected at one end to the fourteenth terminal 124N, passed through the fourteenth interelectrode groove 142*n*, routed around the side surface of the terminal support base 142M supporting the thirteenth terminal 124M, hooked over the hook part 146, passed through the notch 122Ac, and wound uniformly about the first through fourth sections 121*b*-121*e* while being sequentially passed through the notches 122Bc-122Dc. After being wound uniformly around all sections, the second primary coil Np2 is passed sequentially back through all notches present between the section in which the second primary coil Np2 was last wound and the fifteenth terminal 124O along an extension to the line connecting the hook part 146 and notch 122Ac, hooked over the hook part 146, routed around the side surface of the terminal support base 142N supporting the fourteenth terminal 124N, passed through the fifteenth interelectrode groove 142*o*, and electrically connected at the other end to the fifteenth terminal 124O.

As described above, all primary coils wound about the cylinder part 121 are electrically connected to terminals while being hooked over one of the hook parts 145 and 146 provided between the terminals and the cylinder part 121. Hence, since the hook part 145 or hook part 146 restricts all primary coils from rising upward between the cylinder part 121 and the respective terminal, secondary coils can be routed without interference from all primary coils, thereby improving the efficiency of the machine-automated operation.

Figure 25:
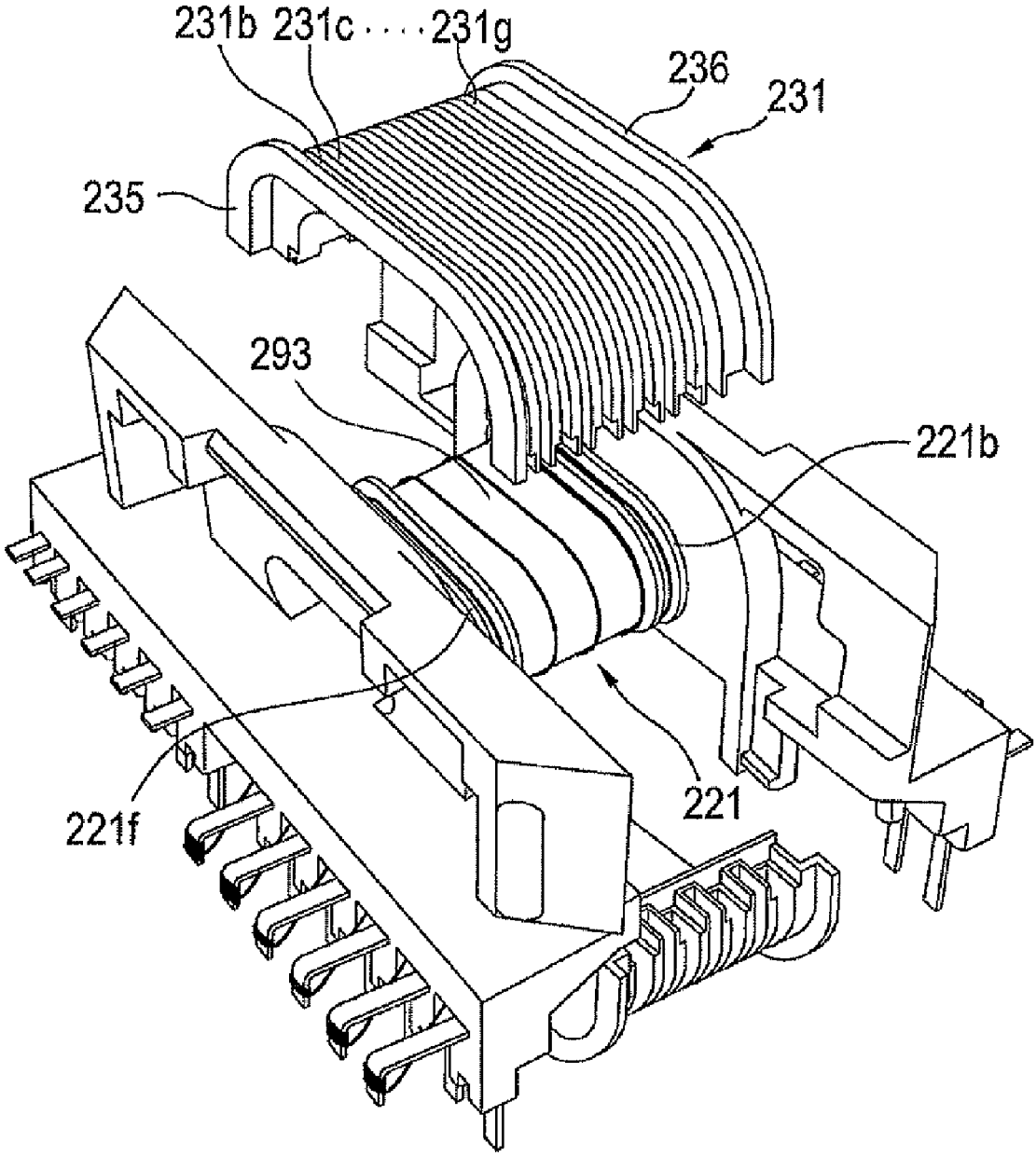
FIG. 25 is a top perspective view of an inner cylinder, a terminal base, and an outer cylinder of a transformer according to a modification of the first embodiment.

While coil components of the invention have been described in detail with reference to specific embodiments thereof, it would be apparent to those skilled in the art that many modifications and variations may be made therein without departing from the spirit of the invention, the scope of which is defined by the attached claims. For example, as shown in FIG. 25, the peripheral surface of an inner cylinder part 221 defining the bottom surface of sections 221*b* and 221*f* on both axial ends of the inner cylinder part 221 may be formed higher in an outwardly radial direction of the inner cylinder part 221 than the peripheral surface of the inner cylinder part 221 defining the other sections, and the peripheral surface of an outer cylinder part 231 defining the bottom surfaces of sections 231*b*-231*g* may be formed at a height in the radial direction of the cylinder part 121 that is flush with the bottom surface of the sections 221*b* and 221*f* on axial ends of the inner cylinder part 221. With this construction, the outer cylinder part 231 is accommodated in a space defined by the sections 221*b* and 221*f* and an insulating tape 293.

With outer flanges 235 and 236 provided on axial ends of the outer cylinder part 231, this configuration allows the secondary coils wound about the sections 231*b* and 231*g* of the outer cylinder part 231 to be placed adjacent to primary coils wound about the sections 221*b* and 221*f* of the inner cylinder part 221. In other words, the secondary coils wound about the sections 231*b*-231*g* of the outer cylinder part 231 can be surrounded by the primary coil wound about the section 221*b* of the inner cylinder part 221, the primary coils wound about sections 221*c*-221*e* (not shown) beneath the insulating tape 293, and the primary coil wound about the section 221*f* when viewing from a cross section viewed along the axial direction of the outer cylinder part 231, thereby enhancing the magnetic coupling effect of the primary coils and secondary coils.

Further, while the wires 50 and terminal electrodes 24 are electrically connected with solder in the preferred embodiments, these electrical connections may be established through laser welding or another method.

What is claimed is:

1. A transformer comprising:

a bobbin including a core portion extending in an axial direction, and terminal bases fixed at both ends of the core portion in the axial direction;

a plurality of terminal electrode regions provided on the terminal bases, each terminal electrode region being provided with a wire connection part;

a primary coil comprising a plurality of primary wires each having a first winding portion wound over the core portion, a first connecting portion connected to the one of wire connection parts, and a first leading portion extending from the first winding portion to the first connecting portion;

a secondary coil comprising a plurality of secondary wires each having a second winding portion wound over the first winding portion, a second connecting portion connected to remaining one of the wire connection parts, and a second leading portion extending from the second winding portion to the second connecting portion; and a hook part disposed between the core portion and one of the terminal electrode regions and configured to hook at least one of the first leading portion and the second leading portion, thereby preventing the at least one of the first leading portion and the second leading portion from projecting outward from the bobbin, wherein the core portion is provided with a plurality of partition walls arrayed in the axial direction for dividing the core portion into a plurality of wire winding sections, each partition wall being formed with a groove through which at least one of the first leading portions is passed;

wherein the hook part is provided at a position such that one of the primary wires wound over one of the wire winding sections is passed through all grooves present between the one of the wire winding sections and the one of the terminal electrode regions; and wherein the hook part has a portion overlapping with the groove positioned nearest to the hook part as viewed in the axial direction.

2. The transformer according to claim 1, wherein the hook part is generally L-shaped and the hook part has one end fixed to the one of the terminal bases.

3. The transformer according to claim 1, wherein the plurality of grooves formed in the plurality of partition walls are arrayed linearly in the axial direction.

4. The transformer according to claim 1, further comprising a cover positioned radially outwardly of the core portion to cover an entire peripheral region of the core portion.

5. A method for manufacturing a transformer comprising:

preparing a transformer body including:

a bobbin including a core portion on which a plurality of primary wires are to be wound, and terminal bases fixed at both ends of the core portion in an axial direction of the core portion, the core portion being provided with a plurality of partition walls arrayed in the axial direction for dividing the core portion into a plurality of wire winding sections and the plurality of partition walls being respectively formed with a plurality of grooves;

a plurality of terminal electrode regions provided on the terminal bases and provided with wire connection parts to which ends of the plurality of primary wires and a plurality of secondary wires to be wound over the plurality of primary wires are to be connected, the plurality of terminal electrode regions being provided with a plurality of terminal electrodes, respectively, and an inter-electrode groove being defined between neighboring terminal electrodes; and a hook part disposed between the core portion and one of the terminal electrode regions for hooking at least one of the primary wire and the secondary wire, thereby preventing the at least one of the primary wire and the secondary wire from projecting outward from the bobbin, wherein the core portion is provided with a plurality of partition walls arrayed in the axial direction for dividing the core portion into a plurality wire winding sections, each partition wall being formed with a groove through which at least one of the first leading portions is passed;

wherein the hook part is provided at a position such that one of the primary wires wound over one of the wire winding sections is passed through all grooves present between the one of the wire winding sections and the one of the terminal electrode regions; and wherein the hook part has a portion overlapping with the groove positioned nearest to the hook part as viewed in the axial direction;

connecting the primary wire to one of the wire connection parts;

passing the primary wire connected to the one of the wire connection parts through the inter-electrode groove;

hooking the primary wire on the hook part;

winding the primary wire over an intended wire winding section after passing the primary wire through all grooves of the partition walls from the groove nearest to the hook part to the groove nearest to the intended wire winding section;

hooking the primary wire on the hook part after the primary wire wound over the wire winding section has been passed through the all grooves of the partition walls from the groove nearest to the intended wire winding section to the groove nearest to the hook part;

passing the primary wire hooked over the hook part through the inter-electrode groove; and connecting the primary wire to remaining one of the connection parts of the terminal electrodes.

* * * * *